US009801448B1

(12) United States Patent
Jakubow

(10) Patent No.: US 9,801,448 B1
(45) Date of Patent: Oct. 31, 2017

(54) MONO-DIRECTIONAL SONIC MOVEMENT LOTION, CREAM AND SHAVING CREAM FOR MEN APPLICATION APPARATUS AND METHOD

(71) Applicant: Rafael Jakubow, West Palm Beach, FL (US)

(72) Inventor: Rafael Jakubow, West Palm Beach, FL (US)

( * ) Notice: Subject to any disclaimer, the term of this patent is extended or adjusted under 35 U.S.C. 154(b) by 0 days.

(21) Appl. No.: 14/148,628

(22) Filed: Jan. 6, 2014

(51) Int. Cl.
*A45D 27/06* (2006.01)
*A46B 13/00* (2006.01)
*A45D 27/00* (2006.01)

(52) U.S. Cl.
CPC ..... *A45D 27/06* (2013.01); *A46B 13/001* (2013.01); *A45D 2027/006* (2013.01)

(58) Field of Classification Search
CPC . A46B 13/00; A46B 13/001; A46B 2200/102; A46B 2200/1033; A61C 17/22; A61C 17/222; A61C 17/32; A61C 17/34; A61C 17/3481; A61C 17/3454; A61C 17/3445; A61C 17/3463
USPC ..... 15/22.1, 22.2, 33, 37; 132/238, 75.8, 132/73.6; 604/67, 69, 70, 72, 73, 95, 97, 604/114, 18
See application file for complete search history.

(56) References Cited

U.S. PATENT DOCUMENTS 2,314,117 A * 3/1943 Beckner ..... 15/23
3,030,647 A * 4/1962 Peyron ..... A45D 40/28 118/57
3,517,235 A * 6/1970 Godel et al. ..... 310/80
3,699,952 A * 10/1972 Waters ..... A61H 7/005 15/22.1
3,935,869 A * 2/1976 Reinsch ..... 132/271
3,964,502 A * 6/1976 Komatsu ..... A45D 20/50 132/119.1
4,027,348 A * 6/1977 Flowers et al. ..... 15/22.1
4,139,014 A * 2/1979 Rowland ..... A45D 20/50 132/118
4,471,504 A * 9/1984 Andersson ..... A46B 9/04 15/22.1
5,343,881 A * 9/1994 Golan ..... A45D 24/30 132/119.1
5,471,695 A * 12/1995 Aiyar ..... 15/22.1
5,909,754 A * 6/1999 Oh ..... A46B 13/06 15/22.1
9,032,576 B2 * 5/2015 Zelickson et al. ..... 15/22.1
(Continued)

FOREIGN PATENT DOCUMENTS

WO WO 2007/058400 * 5/2007 ..... A46B 13/02

*Primary Examiner* — Tatiana Nobrega
(74) *Attorney, Agent, or Firm* — Frank L. Kubler

(57) ABSTRACT

A brush includes a brush head moving mechanism and a removable brush head for applying flowable matter to a surface, the brush head including a chamber for retaining flowable matter, a chamber delivery wall with outwardly protruding bristles and with delivery ball ports among the bristles into each of which a matter delivery ball is rotatably seated and retained by ball retaining structures to partly protrude through the delivery wall, and an opposing chamber mounting wall with brush head mounting means for connecting the brush head to the moving mechanism, and having a chamber side wall interconnecting the chamber delivery wall and the chamber mounting wall to form a closed and sealed container for the flowable matter.

4 Claims, 22 Drawing Sheets

(56) References Cited

U.S. PATENT DOCUMENTS

| | | | | |
|---|---|---|---|---|
| 2003/0084524 | A1* | 5/2003 | Blaustein et al. | 15/22.1 |
| 2003/0131427 | A1* | 7/2003 | Hilscher | A61C 17/3472 15/22.1 |
| 2005/0138740 | A1* | 6/2005 | Alfano | 15/22.1 |
| 2006/0010625 | A1* | 1/2006 | Tapper et al. | 15/97.1 |
| 2006/0021166 | A1* | 2/2006 | Hills | 15/23 |
| 2006/0021169 | A1* | 2/2006 | Choo | 15/97.1 |
| 2007/0123808 | A1* | 5/2007 | Rhoades | 601/73 |
| 2007/0251033 | A1* | 11/2007 | Brown et al. | 15/22.1 |
| 2008/0271271 | A1* | 11/2008 | Chan | 15/22.2 |
| 2012/0124758 | A1* | 5/2012 | Sabisch et al. | 15/21.1 |
| 2013/0156487 | A1* | 6/2013 | Haan | 401/143 |
| 2013/0198980 | A1* | 8/2013 | Iwahori et al. | 15/22.1 |

* cited by examiner

Fig, 19

MONO-DIRECTIONAL SONIC MOVEMENT LOTION, CREAM AND SHAVING CREAM FOR MEN APPLICATION APPARATUS AND METHOD

BACKGROUND OF THE INVENTION

1. Field of the Invention

The present invention relates generally to the field of cosmetics application devices including brushes. More specifically the present invention relates to a brush including a handle base which is hollow and preferably has a generally tubular housing with closed ends and containing an attachment moving mechanism for moving an attachment such as a brush head relative to the handle base and at least one removable attachment such as a brush head for applying flowable matter to a surface, such as lotions, creams and shaving cream for men to user skin.

A first embodiment of the handle base includes an attachment moving mechanism which rotates the brush head about its axis nine degrees in one rotational direction and then stops and reverses and rotates the brush head about its axis a certain number of degrees, and once again preferably nine degrees, in the opposing rotational direction. The attachment rotates back and forth preferably at a frequency of 250 to 400 cycles per second and as a result effectively vibrates, so that this embodiment is referred to as sonic or ultrasonic.

Some embodiments include rotating attachments or rotating attachment elements, while others include reciprocating elements. For all embodiments where reciprocating motion is provided, this motion is always produced by a sonic or ultrasonic reciprocating mechanism such as linear reciprocating mechanism for a removable brush head or other attachment having a return spring. As a result, the attachment mount to which an attachment is affixed and which connects to the reciprocating mechanism always starts from one extreme end of its range of reciprocating motion to produce mono-directional movement. Therefore the neutral position is at one absolute end point of the brush head movement path and therefore can never be crossed, whether the reciprocation is along a linear or curvilinear path or is rotational. The present invention specifically avoids bi-directional movement relative to the neutral position because it is believed that stretching the user skin in only one direction is gentiler to the skin and is best for cleansing and lotion and cream application. The return spring preferably is a resilient strip or panel extending between and is connected to the mechanism housing and the reciprocating attachment mount, such as brush guide arm, although the use of a coil spring or of other equivalent biasing mechanism is contemplated.

The brush head preferably includes a chamber for retaining flowable matter so that the brush head effectively becomes a container. The chamber has a chamber delivery wall with outwardly protruding bristles and with delivery ball ports among the bristles into each of which a matter delivery ball is rotatably seated and retained by ball retaining means to partly protrude through the delivery wall, and has an opposing chamber mounting wall with brush head mounting means for connecting the brush head to the brush head moving mechanism, and having a chamber side wall interconnecting the chamber delivery wall and the chamber mounting wall to form a closed and sealed container for the flowable matter.

A primary contemplated function of the present brush is the application of shaving cream for men. A quantity of such shaving cream is placed in the chamber and deposited onto facial skin by the rolling of the matter delivery balls. Then the bristles rub the deposited shaving cream against user whiskers at sonic frequency, thereby softening the whiskers and lubricating the skin so that they are easily removed by a razor without the need to apply significant force against the skin, providing a close shave without skin abrasions. As an alternative to sonic oscillation of the brush head, the brush head is rotated relative to the skin for a short time in one rotational direction, such as one minute, and then for a short time in the directly opposing rotational direction. In either instance, the shaving cream filled brush is an improvement over the shaving cream tray and hand moved brush used by previous generations of men.

A method is provided of preparing the whiskers on the face of a man for shaving, including the steps of placing a quantity of shaving cream into a chamber within a brush head having bristles, progressively releasing the shaving cream onto facial skin and whiskers while simultaneously moving the bristles over the skin and whiskers, either with brush head rotation reversal at what is referred to herein as sonic speed, thereby softening the whiskers and lubricating the skin.

The brush handle is elongate and contains a brush head drive shaft and a drive shaft passing port through which the drive shaft protrudes from inside the handle and is connected to a brush head rotation assembly within the handle. The brush head rotation assembly includes an assembly annular mounting plate with screw ports for screwing to the inner surface of the handle so that the annular mounting plate surrounds the drive shaft passing port and the drive shaft. The drive shaft rotates freely within and relative to the annular mounting plate. The drive shaft has a shaft inward end connected to an L-shaped drive panel extending radially outward from the drive shaft and then rearwardly where the drive panel connects to a drive disk concentric with the drive shaft and having a radial disk arm with a panel secured to the disk arm free end fitted with two parallel and spaced apart block magnets. A resilient first return spring panel extends between and is connected to the mounting plate and the drive disk and is oriented to extend radially outward from the drive shaft rotational axis, having a slot adjacent to the mounting plate through which the drive panel passes. The first return spring panel preferably tapers from a wider panel end connected to the mounting plate to a narrower panel end connected to the drive disk, because this configuration makes the panel much less susceptible to metal fatigue and cracking, and may also improve twisting and torque characteristics. A resilient second return spring panel preferably is connected to and extends between the mounting plate and the drive disk to add greater twisting resistance and return torque. The second return spring panel preferably tapers at its center, once again because this configuration makes the panel much less susceptible to metal fatigue and cracking, and may also improve twisting and torque characteristics.

A reciprocating rotation mechanism is provided for causing the drive disk and thus the drive shaft to rotate in one rotational direction against the biasing of the first and second return spring panels and then to stop and rotate in the opposing rotational direction, again against the biasing of the first and second return spring panels. Once again, the preferred number of degrees the brush head rotation assembly and drive shaft are rotated in each rotational direction is nine degrees.

A retracting ball delivery apparatus for flowable material such as creams, lotion, medications and vitamins is further provided. The apparatus includes a delivery retracting ball and ball assembly and a cartridge containing flowable material and in fluid communication with the ball assembly and ball. The ball assembly preferably includes a ball assembly inner shell having a distally located ball port smaller in diameter than the ball into which the ball seats from outside the ball assembly inner shell and a spring within the assembly inner shell bearing against and biasing the ball to retractably and rotatably seat in the ball port, and a cartridge mount to which an open end of a material cartridge is sealingly and removably fitted. Material is delivered from the cartridge to the retracting ball through the ball assembly inner shell, such that dragging the ball over a target surface causes the ball to rotate while retracting against the biasing of the spring so that material deposited on the ball within the assembly inner shell rolls out between the ball and port rim as the ball rotates against the target surface, carrying a uniform film or layer of material and depositing it on the target surface. The novel retractability of the biased ball, a key feature of the present invention, permits the material to exit the assembly housing on the ball while the ball is pressed against a target surface such as user skin, because the biased ball bears against the rim of the ball outer shell port and seals against release of material when there is no force against the ball from a target surface, so that material is only dispensed when the ball is in contact with a surface intended to receive the material.

The assembly inner shell includes an inner shell side wall which preferably is cone-shaped or funnel-shaped having at its narrower distal end the ball port and at its wider proximal end an assembly inner shell end wall with a central assembly inner shell material receiving opening. A tubular material passageway preferably is attached to the assembly inner shell end wall and protrudes distally from and encircles the material receiving opening. The ball spring preferably is a coil spring slidably fitted around the material passageway, which acts as a spring retaining guide, so that the ball spring is always compressed between the ball and the assembly inner shell end wall. The cartridge mount preferably includes a tubular cartridge fitting protruding proximally from the assembly inner shell end wall and also encircles the material receiving opening. A material cartridge preferably is a hollow cylinder and the cartridge open end preferably is the at a cartridge distal end, and this cartridge distal end fits snugly and engagingly into the tubular cartridge fitting to place the cartridge in fluid communication with the assembly inner shell through the material receiving opening. The cartridge open end preferably has a reduced diameter to define a cartridge neck and a cartridge shoulder at the cartridge distal end.

The ball assembly inner shell is releasably secured to a tubular apparatus housing, and the cartridge extends from the assembly inner shell inside the apparatus housing. It is preferred that the ball assembly includes an assembly outer shell of translucent plastic with a ball opening at the apparatus housing distal end registering with and of at least the diameter of the ball port, and a tubular outer shell lip segment protruding proximally beyond the ball assembly inner shell. The outer shell lip segment preferably has internal threads which are sized to mesh with external threads on the apparatus housing distal end so that the ball assembly inner shell can be screwed onto and off of the apparatus housing to provide access to change an empty material cartridge and to perform any other desired maintenance.

The ball preferably is formed of stainless steel. The apparatus housing and assembly inner shell preferably are formed of aluminum.

When the target surface is user skin, a preferred feature of the apparatus in addition to the retracting ball is a ball charging circuit delivering a small electric voltage and current to the ball to stimulate the user skin during application of the material. An electric power source is connected to the cartridge and to the conductive material within the cartridge through an apparatus circuit, so that the material conducts and delivers electric voltage and current to the ball. A switch preferably is included in the apparatus circuit and preferably is mounted to the apparatus housing to be operable from outside the housing, and controls the flow of electric current to the ball weather to start or stop the current or to control its magnitude. The switch preferably is a spring-loaded button which closes the circuit to deliver current to the ball only while depressed by a user finger. The power source preferably is at least one battery such as conventional AAA batteries which are retained in a battery region within the apparatus housing, and located either distally or proximally of the material cartridge. A removable battery access cap preferably is provided at the apparatus housing proximal end which can be unscrewed from the apparatus housing to release spent batteries and to permit insertion of new batteries in their place. Within the battery access cap is an battery spring in the form of a distally protruding coil spring which bears against the proximal end of the nearest battery.

One version of the apparatus places the cartridge between the batteries and the assembly inner shell, so that the cartridge is directly fitted to the assembly inner shell as above described. The cartridge is replaced by unscrewing the assembly outer shell from the apparatus housing and pulling the cartridge free of the cartridge mount, and fitting an fresh, full cartridge to the cartridge mount as described.

Another version of the apparatus places the cartridge at the proximal end of the apparatus housing, proximal of the batteries, so that the exposed and protruding from the apparatus housing. An advantage of this version is that the user can continually visually monitor the amount of material remaining in a transparent cartridge, and replace the cartridge when spent without having to open the apparatus housing. For this version, the apparatus housing has an apparatus housing proximal end wall with a material passing opening similar to the material receiving opening in the assembly inner shell end wall and a tubular cartridge fitting into which the cartridge distal end snugly, engagingly sealingly and removably fits. A material delivery tube preferably carries the material from the cartridge distally through the interior of the apparatus housing and into the assembly inner shell.

A preferred additional feature of the apparatus is a vibrating element contained within the apparatus housing and connected to the apparatus circuit for causing the ball to vibrate or pulsate. Operation of the vibrating element preferably is controlled by the same switch controlling the delivery of electric current to the ball, although it is contemplated that vibrating element operation may be controlled by a separate switch. The vibrating element may be of any suitable design, and a preferred vibrating element includes the electric motor with a weight eccentrically mounted to the motor drive shaft.

The inventive retracting ball assembly also is optionally affixed to or incorporated into devices of other configurations. This version of the apparatus includes two vibrating and independently pivoting arms and a ball assembly incorporated into each arm free end.

2. Description of the Prior Art

There have long been brushes for spreading cosmetic materials over the skin of a user. A problem with these prior brushes has been that the cosmetics materials are usually not spread over the skin evenly. Another problem has been that these brushes do not retain the material to be distributed, so that time is lost transferring quantities of the material to the skin. Finally, those that are electric and automatically rotate a brush head only rotate the head about four degrees in each rotational direction, which is inadequate to sufficiently deposit and spread cosmetic materials.

It is thus an object of the present invention to provide a lotion and cream application brush and brush head which delivers flowable matter over user skin evenly.

It is another object of the present invention to provide such a brush and brush head which does not waste flowable matter such as expensive cosmetic creams.

It is still another object of the present invention to provide such a brush head which retains a lotion or cream to be applied, and which meters out the lotion or cream as the brush is drawn across the user skin.

It is yet another object of the present invention to provide a flowable material delivery apparatus which meters out a substantially uniform layer of material onto a target surface such as user skin with a rotating, retracting ball, so that coverage is complete and yet no material is wasted.

It is yet a further object of the present invention to provide such a flowable material delivery apparatus which is neat to use because it delivers material from easily replaceable cartridges so that no direct application with fingers is needed.

It is a still further object of the present invention to provide such a flowable material delivery apparatus which can mount rotating attachments such a brush heads to a handle base containing a motor and an attachment mount including the motor drive shaft to rotate the entire brush head, or so that the attachment remains fixed relative to the base handle and elements of the attachment rotate relative to the remainder of the attachment such as brush heads, or so that the attachment moves linearly or rotationally back and forth in a reciprocating motion mono-directionally from a neutral point at one extreme end of the path of reciprocation.

It is finally an object of the present invention to provide such a brush and brush head which are relatively simple in construction and inexpensive to manufacture.

SUMMARY OF THE INVENTION

The present invention accomplishes the above-stated objectives, as well as others, as may be determined by a fair reading and interpretation of the entire specification.

A brush is provided including a brush head moving mechanism and a removable brush head for applying flowable matter to a surface, the brush head including a chamber for retaining flowable matter, a chamber delivery wall with outwardly protruding bristles and with delivery ball ports among the bristles into each of which a matter delivery ball is rotatably seated and retained by ball retaining structures to partly protrude through the delivery wall, and an opposing chamber mounting wall with brush head mounting means for connecting the brush head to the moving mechanism, and having a chamber side wall interconnecting the chamber delivery wall and the chamber mounting wall to form a closed and sealed container for the flowable matter.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figures 1, 1A, 2:
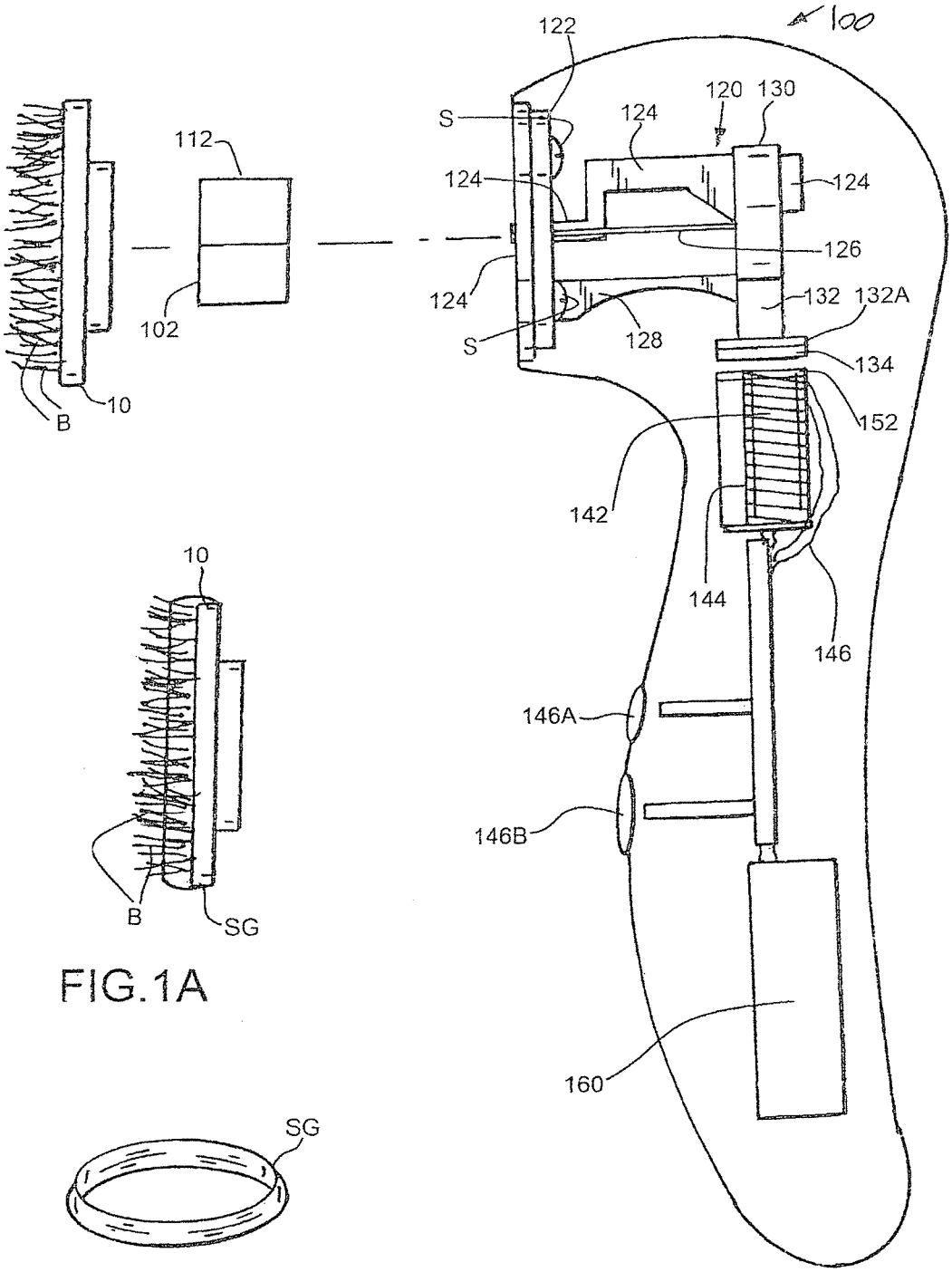
FIG. 1 is a cross-sectional side view of the preferred brush and the present inventive brush head in a size exploded view.
FIG. 1A is a side view of the present brush head.
FIG. 2 is a perspective view of the splash guard.
Figure 3:
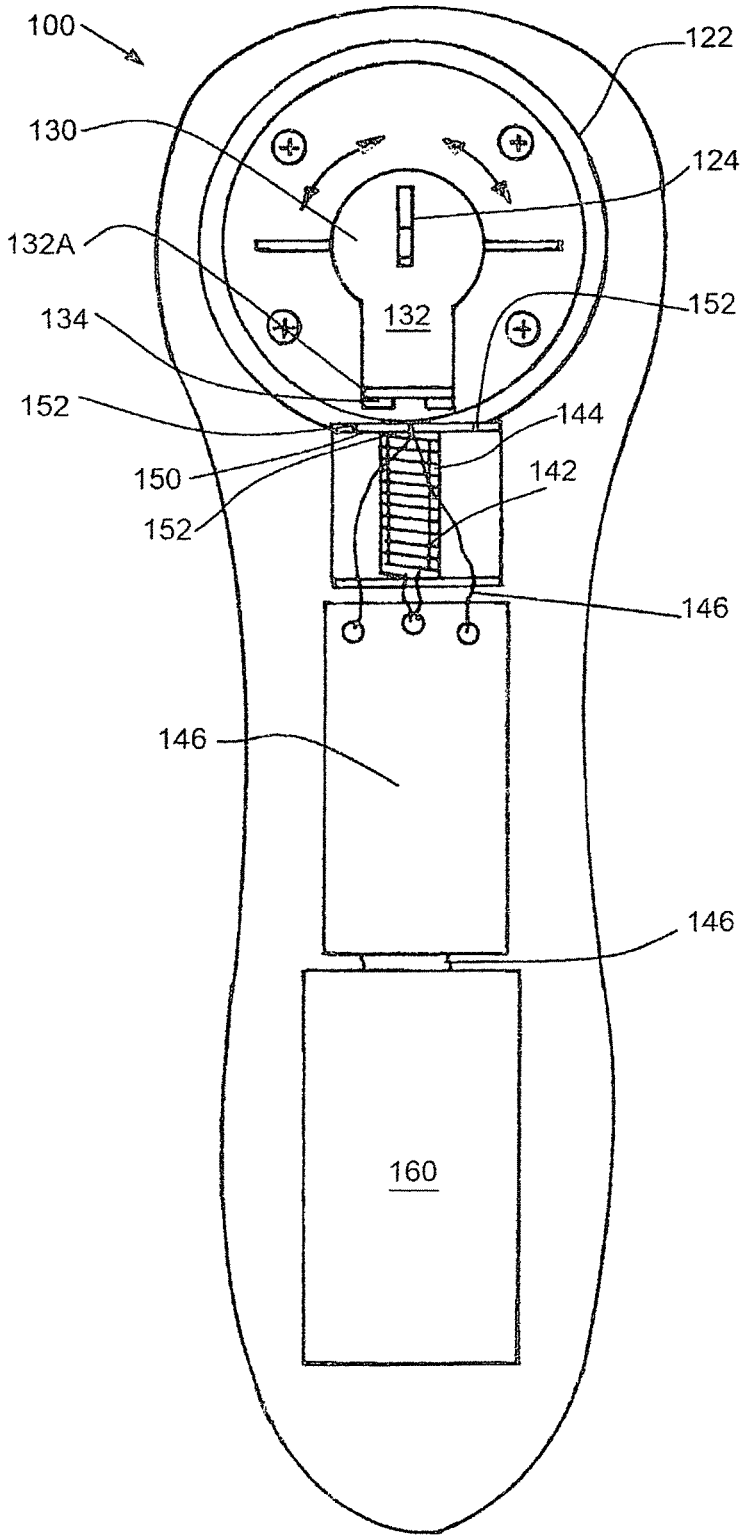
FIG. 3 is a cross-sectional rear view of the brush of FIG. 1.
Figure 12:
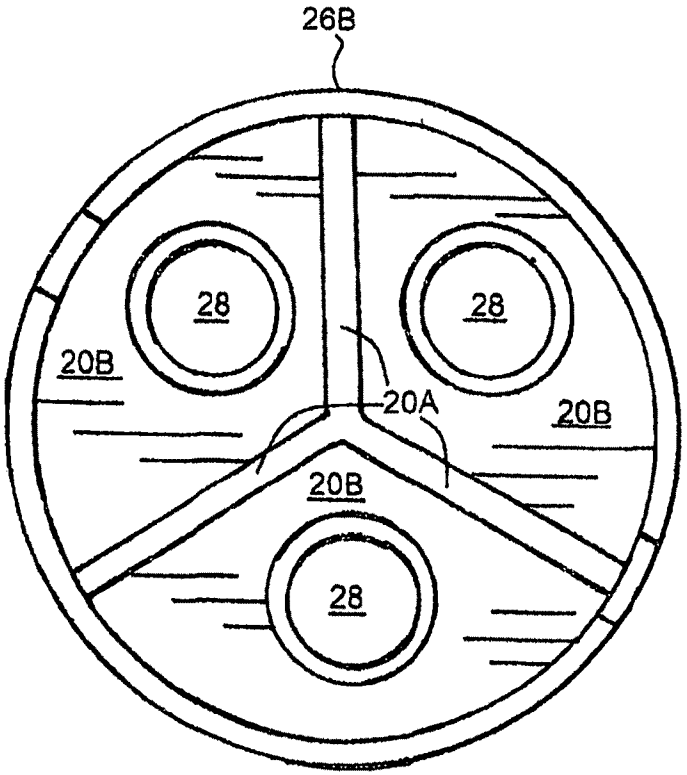
FIG. 12 is a cross-sectional rear view of the preferred present brush head, revealing the chamber internal walls and the chamber compartments.
Figure 4:
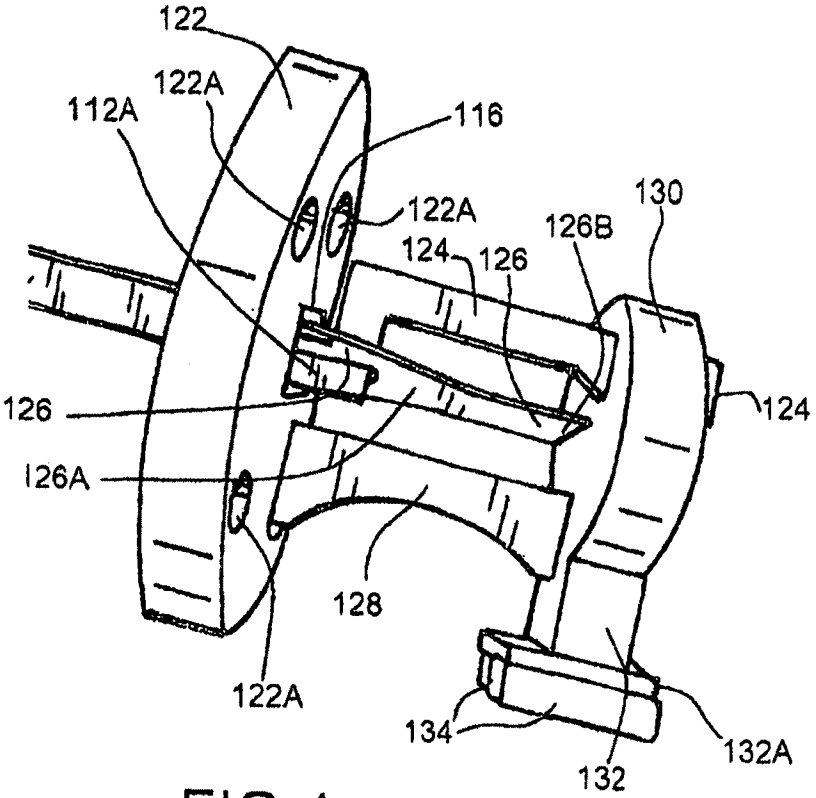
FIG. 4 is a perspective side view of the present brush head rotation assembly.
Figure 5:
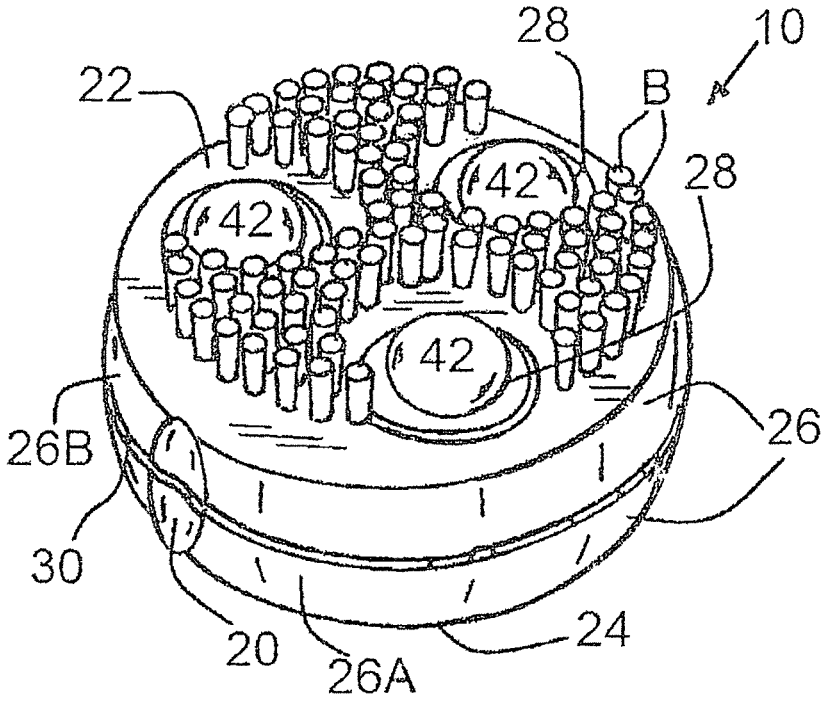
FIG. 5 is perspective view of the delivery wall end of the present brush head showing the preferred three delivery balls.
Figure 10:
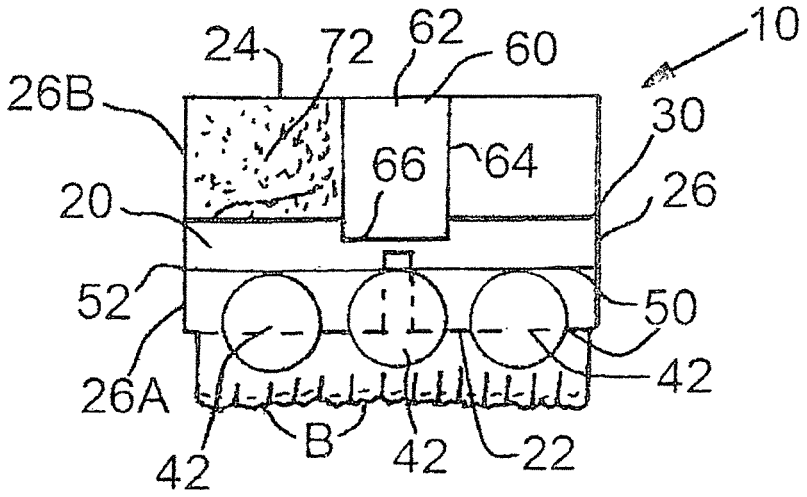
FIG. 10 is a cross-sectional side view of the brush head of FIG. 2, showing a partial view of the annular sponge.
Figure 6:
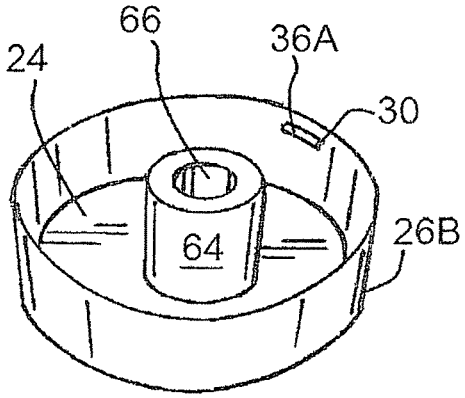
FIG. 6 is a perspective view of the interior of the mounting wall portion of the chamber including the second side wall segment.
Figure 7:
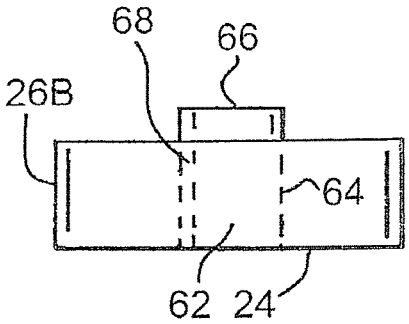
FIG. 7 is a side view of the mounting wall portion of the chamber of FIG. 6, with hidden parts of the central mounting tube and keyway shown in broken lines.
Figure 8:
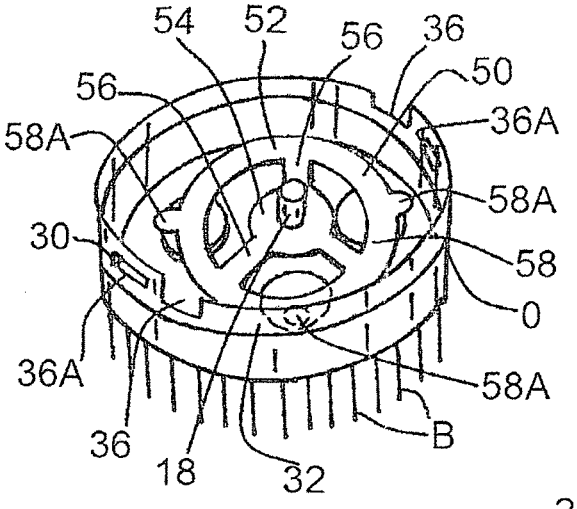
FIG. 8 is a perspective view of the interior of the mounting wall portion of the chamber including the second side wall segment.
Figure 9:
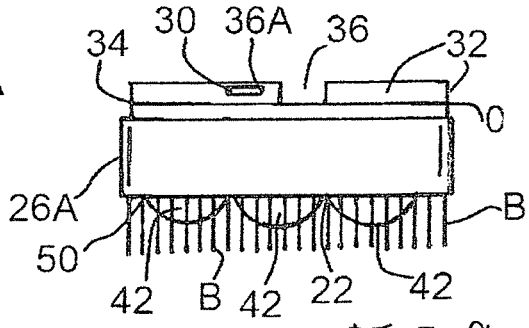
FIG. 9 is a side view of the mounting wall portion of the chamber of FIG. 6.
Figure 11:
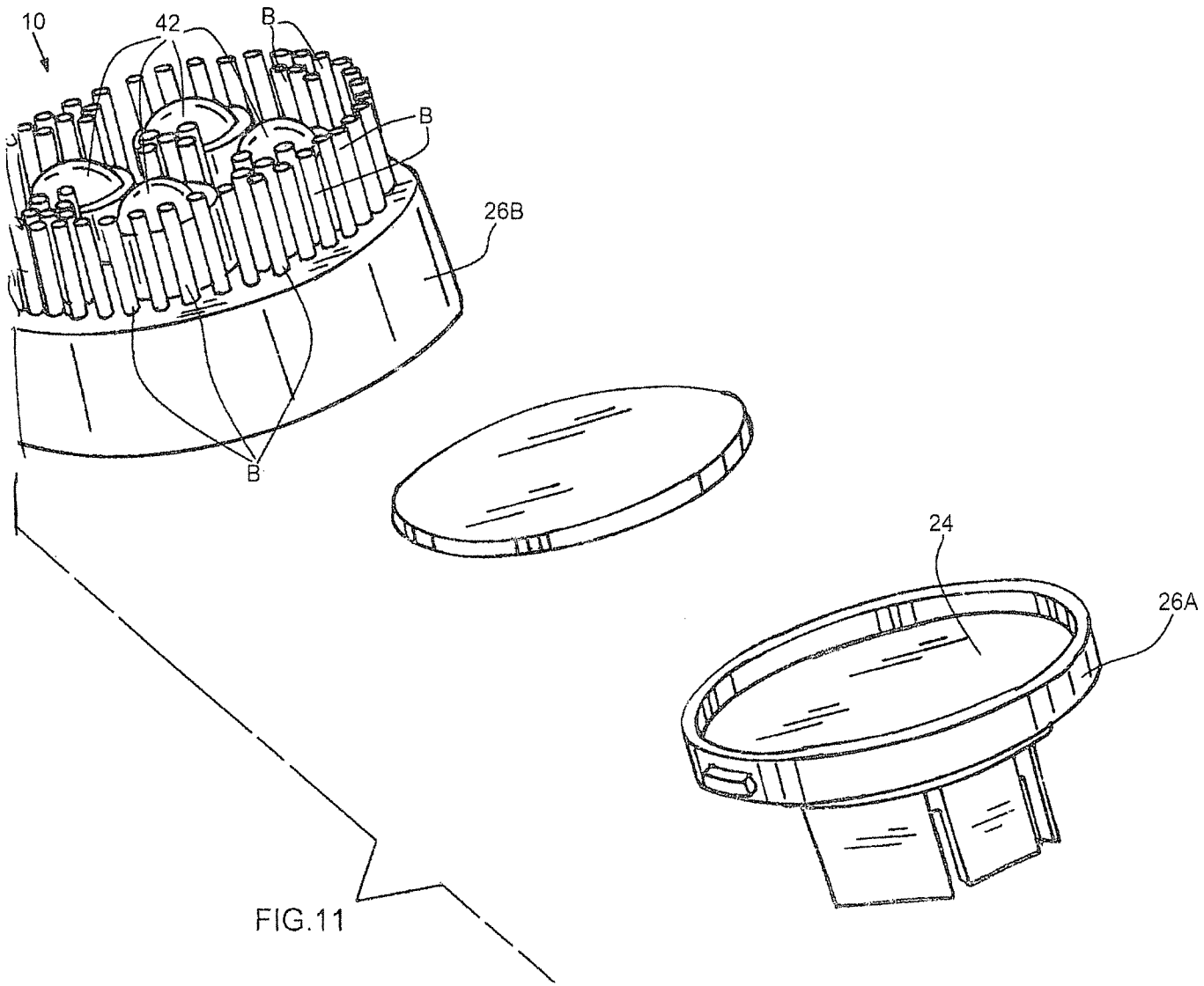
FIG. 11 is a diagonally exploded view of a preferred brush head of the present invention. The brush head in this FIGURE has four balls rather three as in the remaining FIGURES. A brush head with four balls preferably is used for the body, while a brush head with three balls preferably is used for the face.
Figure 13:
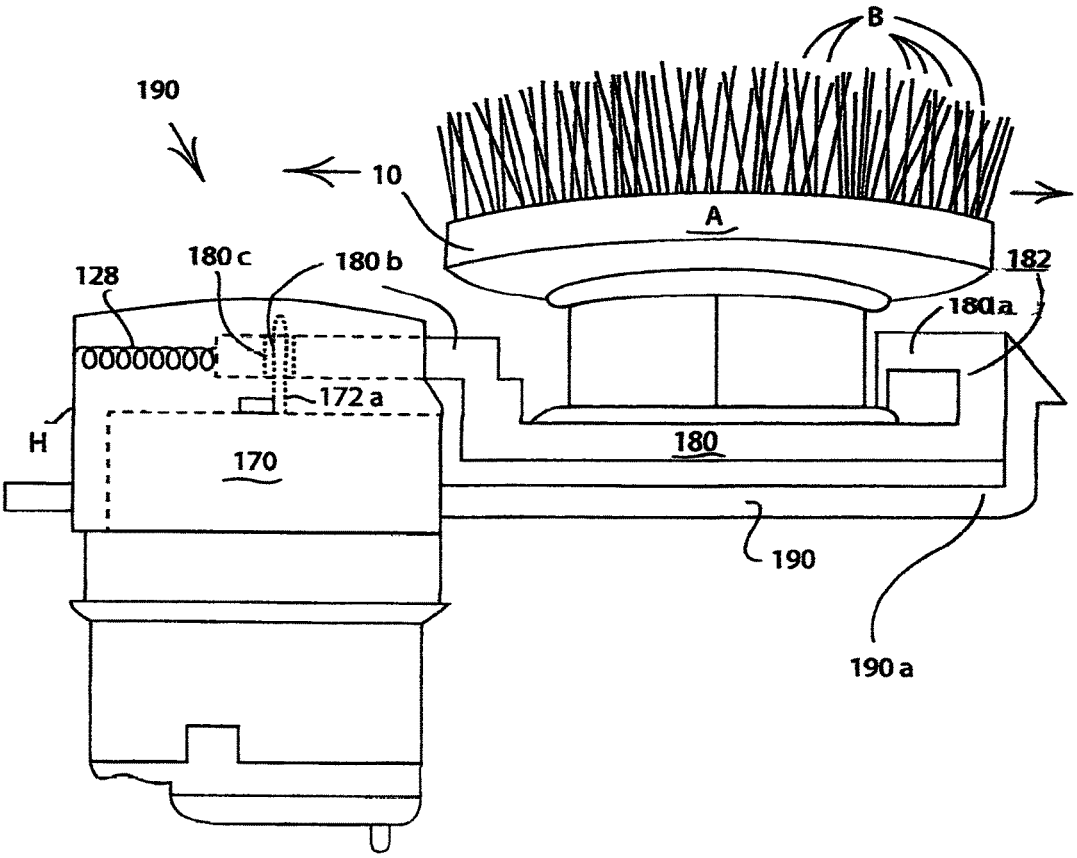
FIG. 13 is a side view of the alternative, linear reciprocating mechanism which oscillates the brush head back and forth linearly, rather than rotationally. The hidden drive motor and eccentric drive shaft portion are shown in broken lines.
Figure 14:
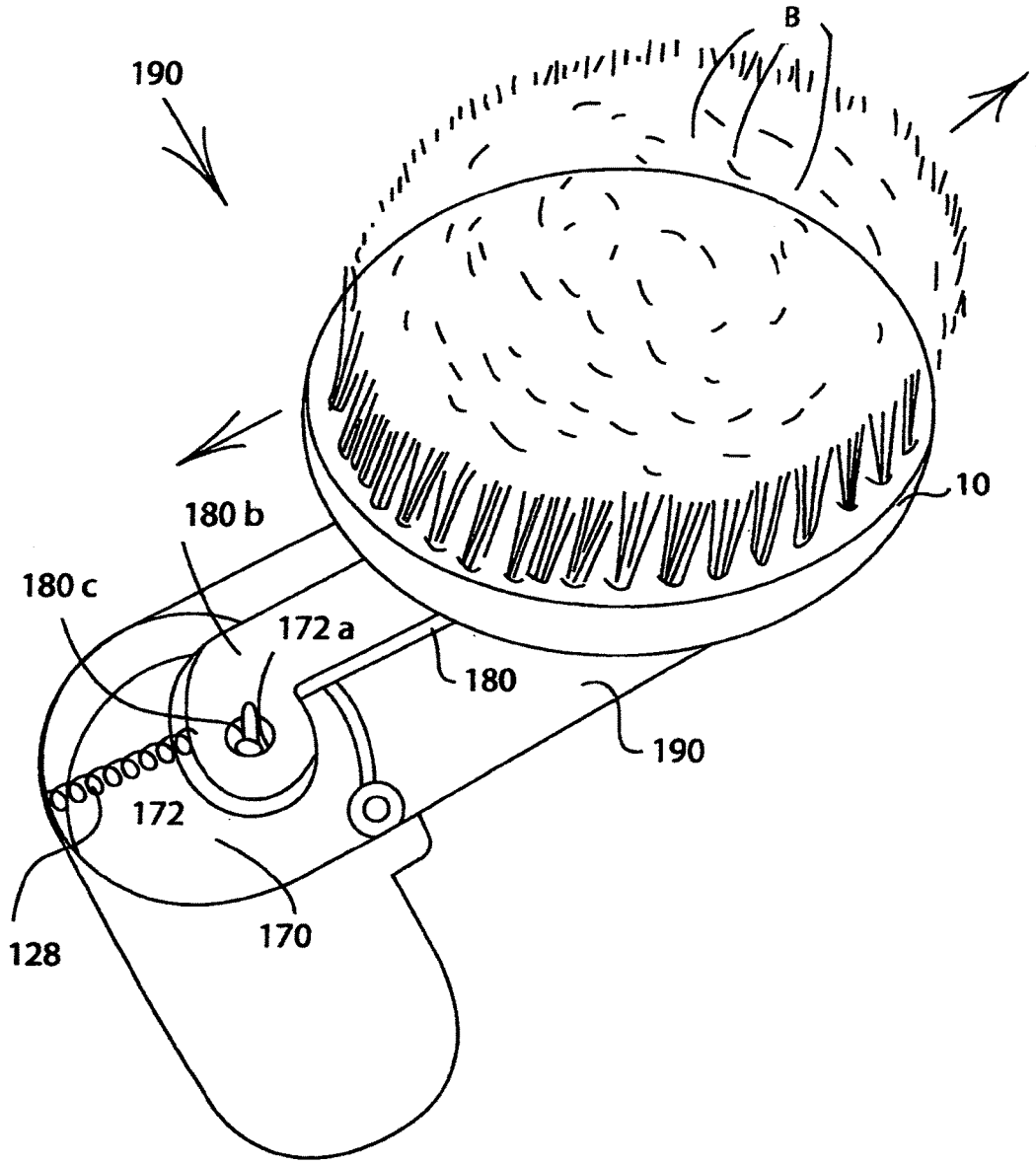
FIG. 14 is a top perspective view of the linear reciprocating mechanism of FIG. 13.
Figure 15:
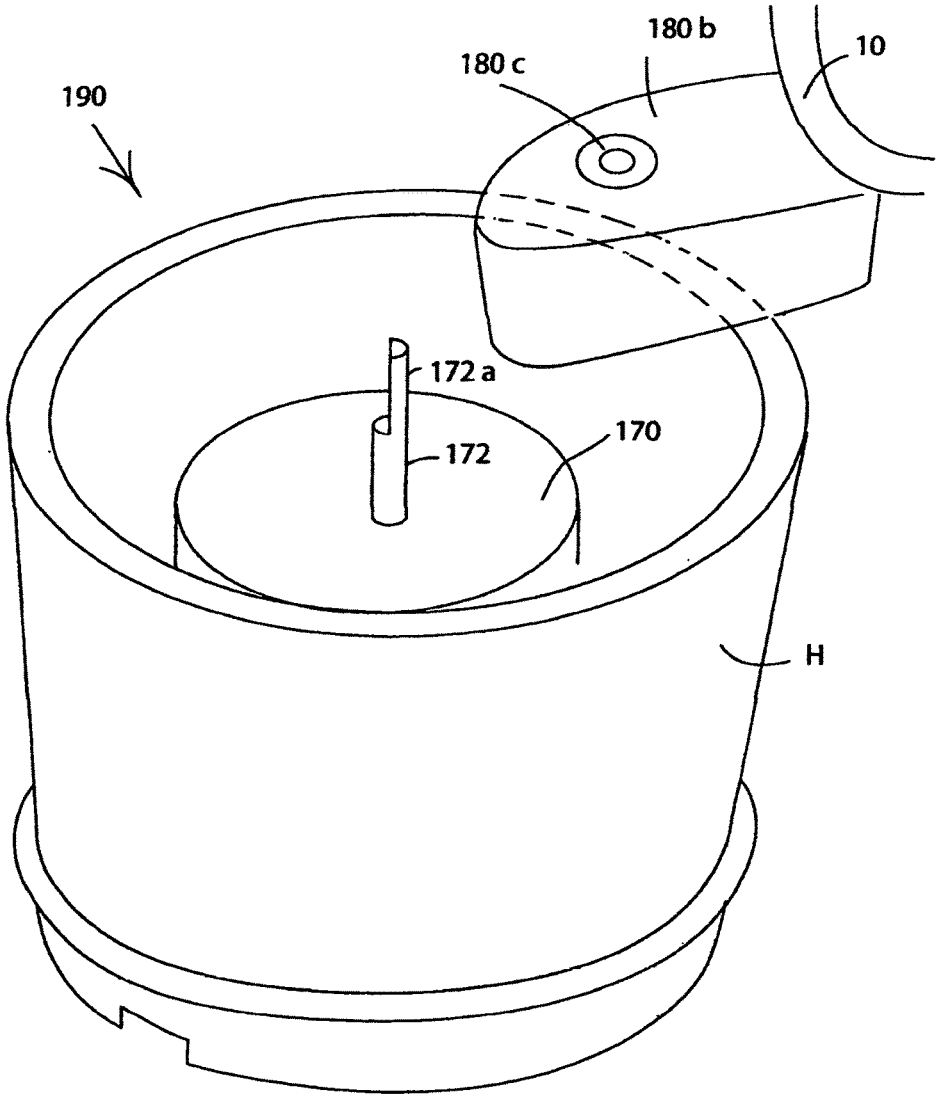
FIG. 15 is an upper perspective close up view of the motor housing and motor inside the motor housing, and the brush guide arm opposing end lifted off the eccentric drive shaft portion to more fully reveal the drive shaft configuration.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments Generally

Referring to FIGS. 1-31, an attachment A preferably in the form of a brush head 10 for a handle base 100 preferably in the form of a brush 100 is disclosed, the brush 100 including a brush head 10 for applying flowable matter to a surface, such as lotions and creams to user skin, and a hollow brush handle 114, having a housing H containing a brush head moving mechanism 110 on which the brush head 10 is removably mounted for moving the brush head 10 in a prescribed motion pattern relative to the handle 114.

The brush head 10 includes a chamber 20 for retaining flowable matter so that the brush head 10 effectively becomes a container. The chamber 20 has a chamber delivery wall 22 with outwardly protruding bristles B and with delivery ball ports 28 among the bristles B into each of which a matter delivery ball 42 is rotatably seated and retained by ball retaining means 50 to partly protrude through the delivery wall 22, and has an opposing chamber mounting wall 24 with brush head mounting means 60 for connecting the brush head 10 to the brush head moving mechanism 110, and having a chamber side wall 26 interconnecting the chamber delivery wall 22 and the chamber mounting wall 24 to form a closed and sealed container for the flowable matter.

The chamber side wall 26 preferably includes a first side wall segment 26A extending from the chamber delivery wall 22 forming a delivery wall end of chamber 20, and a second side wall segment 26B extending from the chamber mounting wall 24 forming a mounting wall end of chamber 20. The chamber side wall 26 further includes side wall segment interlocking means 30 which removably and sealingly connects the side wall segments 26A and 26B together, so that separating the side wall segments 26A and 26B opens the chamber 20 and permits the introduction of flowable material such as a lotion or cream into the chamber 20. The side wall interlocking means 30 preferably includes an inward step 32 formed along the first side wall segment 26A outward edge over which the second side wall segment 26B outward edge snugly and sealingly fits. A circumferential O-ring groove 34 preferably is provided in the outer surface of the first side wall segment 26A into which an O-ring O is fitted to assure that a seal is formed between the first and second side wall segments 26A and 26B when they are fitted together. The first side wall segment inward step 32 preferably includes a tab notch 36 and a circumferentially oriented locking slot 36A circumferentially adjacent to and spaced from the tab notch 36, and the second side wall segment 26B preferably includes an inwardly protruding and circumferentially extending locking tab 36B which is sized and positioned to enter the tab notch 36 when the locking tab 36B is placed in registration with the tab notch 36, and then to fit engagingly into the locking slot 36A when advanced circumferentially out of the tab notch 36.

An attachment mount AM in the form of a the brush head mounting means 60 preferably includes a central mounting opening 62 in the chamber mounting wall 24 and a central mounting tube 64 connected to the chamber mounting wall 24 along the periphery of the mounting opening 62 and extending into the chamber 20 a certain distance. A magnetic end wall 66 is provided across the inward end of the mounting tube 64. The mounting opening 62 and mounting tube 64 are fitted over the drive shaft 112 to mount the brush head 10 to the brush head moving mechanism 110. The free end of the drive shaft 112 has a magnetic plate 102 which magnetically engages the mounting tube magnetic end wall 66. The protruding end of the drive shaft 112 preferably has a hexagonal external cross-section to define the attachment mount AM and the mounting opening 62 preferably has a matching hexagonal internal cross-section so that the mounting opening 62 fits snugly and engagingly over the drive shaft 112 to rotate the brush head 10 with the drive shaft 112.

The brush head 10 preferably includes exactly three delivery balls 42. The delivery balls 42 preferably are formed of either rubber or stainless steel for optimum hygiene. The ball retaining means 50 preferably includes a delivery ball port 28 having a diameter smaller than the corresponding delivery ball 42 so that the ball 42 protrudes outwardly through the ball port 28 but cannot pass through the ball port 28 out of the chamber 20. A ball abutment frame 52 within the chamber 20 extends across and rests against the delivery balls 42, permitting the balls 42 to rotate relative to the chamber delivery wall 22 while keeping the balls 42 seated in their respective delivery ball ports 28. A frame stem 18 preferably protrudes inwardly from the delivery wall 22, and the ball abutment frame 52 preferably is mounted on the frame stem 18, and the inwardly protruding mounting tube 64 holds the ball abutment frame 52 in position on the frame stem 18 and against the delivery balls 42. The ball abutment frame 52 preferably includes a frame center portion 54 having a frame mounting hole 54A for fitting over and around the frame stem 18, and frame spokes 56 extending radially from the frame center portion 54 to a frame ring 58, the frame ring 58 being sized in diameter to directly abut the delivery balls 42. Frame tabs 58A preferably extend radially from the frame ring 58 between the locations of the spokes 56 and over the delivery balls 42.

Where the given brush head 10 is intended to retain a liquid, such as a lotion, an annular sponge 72 for retaining the liquid preferably is inserted into the chamber 20. The annular sponge 72 preferably substantially fills the space between the chamber mounting wall 24 and the ball abutment frame 52 and to extend around the mounting tube 64.

A brush head closure lid 80 preferably is provided for sealingly fitting over the chamber delivery wall 22 and at least part of the first side wall segment 26A. The closure lid 80 preferably includes a lid end wall 82 and a tubular lid side wall 84 sized in diameter to snugly and sealingly fit over the exterior surface of the chamber side wall 26, and preferably over the first side wall segment 26A.

The chamber 20 preferably has chamber internal walls 20A dividing the chamber 20 interior into multiple individually sealed and closed chamber compartments 20B, one directly behind and delivering flowable matter to a corresponding one of the matter delivery balls 42. Therefore, where there are three matter delivery balls 42, as preferred and illustrated in the attached FIGURES, there are three corresponding compartments 20B separated by three chamber internal walls 20A extending radially outward from the center of the chamber 20 and forwardly from the chamber mounting wall 24 to the closure lid 80. These chamber internal walls 20A can perform at least two functions. First, when the brush head 10 is positioned vertically, they prevent the flowable matter inside the brush head 10 from all flowing to the lower end of the chamber 20 and out of contact with the one or more matter delivery balls 42 at the upper end of the chamber 20. The internal walls 20A hold flowable matter close to the adjacent matter delivery ball 42. Second, the multiple compartments 20B permit a different type of flowable matter to be placed in each compartment and thus delivered by the corresponding matter delivery ball 42 onto user skin. Therefore, the illustrated three compartment 20B three matter delivery ball 42 configuration permits simultaneous delivery of three different types of flowable matter, such as solution, skin vitamins and cleanser.

A splash guard SG preferably is provided which is a ring which fits snugly and removably around the perimeter of the chamber side wall 26 and protrudes forwardly from the chamber delivery wall 22 around the bristles B. See FIG. 2. The splash guard SG preferably is a flat strip of flexible and resilient material such as of a suitable plastic formed into a ring. As the brush head 10 rotates, the centrifugal force can cause some of the flowable matter can fly radially off bristles B. The splash guard SG blocks this matter from flying off the brush head 10.

Return Spring for Mono-Directional Reciprocation

For all embodiments where reciprocating motion is provided, this motion is produced by a sonic or ultrasonic reciprocating mechanism RM such as linear reciprocating mechanism 190 for a removable brush head 10 or other attachment having a return spring 128. This reciprocating mechanism RM always causes the attachment mount AM to which an attachment to start from one extreme end of its range of reciprocating motion to produce mono-directional movement. Therefore the neutral position is at one absolute end point P of the brush head 10 movement path, whether the reciprocation is along a linear or curvilinear path or is rotational. The present invention specifically avoids bi-directional movement relative to the neutral position at the end point P because it is believed that stretching the user skin in only one direction is gentler to the skin and is best for cleansing and lotion and cream application. See FIG. 20. The return spring 128 preferably is a resilient strip or panel extending between and is connected to the mechanism housing H and the reciprocating attachment mount AM, such as brush guide arm 180, although the use of a coil spring or of other equivalent biasing mechanism is contemplated.

First Preferred Embodiment

A first embodiment of the brush 100 includes a brush head moving mechanism 110 which rotates the brush head 10 about its axis A nine degrees in one rotational direction and then stops and reverses and rotates the brush head 10 about its axis A a certain number of degrees, once again preferably nine degrees, in the opposing rotational direction. The hollow brush handle 114 is elongate and contains a brush head drive shaft 112 and a drive shaft passing port 116 through which the drive shaft 112 protrudes from inside the handle 114 and is connected to a brush head rotation assembly 120 within the handle 114. The brush head 10 rotation assembly 120 includes an assembly annular mounting plate 122 with screw ports 122A for passing the shanks of screws S to fasten the rotation assembly 120 to the inner surface of the handle 114 so that the annular mounting plate 122 surrounds the drive shaft passing port 116 and the drive shaft 112. The drive shaft 112 rotates freely within and relative to the annular mounting plate 122. The drive shaft 112 has a shaft inward end 112A connected to an L-shaped drive panel 124 extending radially outward from the drive shaft 112 and then rearwardly where the drive panel 124 connects to a drive disk 130 concentric with the drive shaft 112 and having a radial disk arm 132 with a block magnet panel 132A secured to the disk arm 132 free end fitted with two parallel and spaced apart block magnets 134. A resilient first return spring panel 126 extends between and is connected to the mounting plate 122 and the drive disk 130 and is oriented to extend radially outward from the drive shaft rotational axis A, having a slot 126C adjacent to the mounting plate 122 through which the drive panel 124 passes. The first return spring panel 126 preferably tapers from a wider panel end 126A connected to the mounting plate 122 to a narrower panel end 126B connected to the drive disk 130, because this configuration makes the panel 126 much less susceptible to metal fatigue and cracking, and may also improve twisting and torque characteristics. A resilient second return spring panel 128 preferably is connected to and extends between the mounting plate 122 and the drive disk 130 to add greater twisting resistance and return torque. Return spring panel 128 also biases the drive disk 130 and thus the attachment A such as a brush head 10 to always come to rest at one extreme rotational position, so that the disk 130 and connected attachment A always start at a neutral point and can never cross the neutral point, so that rotational movement is mono-directional. The second return spring panel 128 preferably tapers at its center, once again because this configuration makes the panel 128 much less susceptible to metal fatigue and cracking, and may also improve twisting and torque characteristics. Spring return panels 126 and 128 preferably are formed of spring steel.

A reciprocating rotation mechanism 140 is provided for causing the drive disk 130 and thus the drive shaft 112 to rotate in one rotational direction against the biasing of the first and second return spring panels 126 and 128 and then to stop and rotate in the opposing rotational direction, again against the biasing of the first and second return spring panels 126 and 128. Once again, the preferred number of degrees the brush head 10 rotation assembly and drive shaft 112 are rotated in each rotational direction is nine degrees. The brush head 10 rotates back and forth preferably at a frequency of 250 to 400 cycles per second and as a result effectively vibrates, so that this embodiment is referred to as sonic or ultrasonic. The rotation mechanism 140 preferably includes an outer electric coil 142 surrounding, substantially co-axial with and spaced outwardly from an inner electric coil 144. Electric current is delivered from the power source 160 such as a battery through a drive circuit 146 which in turn delivers periodically reversing current through the inner and outer coils 142 and 144, first in one current flow direction and then in the reverse current flow direction. The drive circuit 146 preferably includes a power switch 146A and a speed selection switch 146B. The inner and outer coils 142 and 144 are electrically connected to three terminals 152 protruding through a terminal plate 150 adjacent and directed toward the block magnets 134, so that a middle terminal 152 is centered between the block magnets 134 and the remaining outside terminals 152 extend laterally beyond the respective block magnets 134. The terminals 152 are close enough to the block magnets 134 that the block magnets 134 are within the magnetic fields of terminals 152. As current passes through the coils 142 and 144 in one current flow direction, the polarity of the coil magnetic fields drives the block magnets 134 laterally in a first rotational direction to thereby rotate the drive disk 130 and thus the drive shaft 112 in the first rotational direction. Then as current flow is reversed through the coils 142 and 144, the polarity is reversed as well and the magnetic field drives the block magnets 134 laterally in an opposing direction to thereby rotate the drive disk 130 and thus the drive shaft 112 in a second rotational direction. The drive circuit 146 delivers electric current to the coils 142 and 144 in one current flow direction for a certain pre-set length of time and then reverses the current flow direction for the same pre-set length of time, causing the drive disk 130 and drive shaft 112 to rotate the pre-determined number of degrees in each rotational direction.

A linear reciprocating mechanism 190 for repetitively moving the brush head 10 at high frequency is provided which moves the brush head 10 in linear reciprocation rather than in rotational reciprocation. A motor 170 preferably designed to rotate at 1500 revolutions per minute is provided, and a lateral portion of the free end of the motor drive shaft 172 is cut away so that the remaining drive shaft eccentric portion 172*a* rotates off-center. See FIGS. 13-15. A drive end 180*b* of a brush guide arm 180 has a guide arm slot 180*c* which closely fits over the eccentric drive shaft portion 172*a* and protrudes laterally of the drive shaft 172, and a brush head 10 is affixed to the brush guide arm 180, preferably the brush guide arm opposing end 180*a* opposite the guide arm drive end 180*b*. The guide arm 180 is reciprocally mounted to a structural arm 188 fixed to and relative to the remainder of the brush 100, and a flexible guide arm retaining link 182 preferably connects the guide arm opposing end 180*a* to the structural arm opposing end 188*a*, As a result of this construction, connection of the motor 170 to an electric power source 160 through completion of the brush circuit 146 causes the motor drive shaft 172 to rotate, and the eccentric drive shaft portion 172*a* to rotate off-center, imparting a reciprocal longitudinal motion to the brush guide arm 180, moving the brush head 10 and reciprocally laterally in a cycle and at a speed matching the speed of rotation of the motor drive shaft 172. This fast movement is considered another version of what is termed in this application a sonic or ultrasonic action. For this embodiment, return spring 128 preferably takes the form of a coil spring extending between and connected to the housing H and the guide arm 180 in a direction parallel with the axis of the guide arm reciprocation path. See FIG. 13.

Second Preferred Embodiment

A second embodiment of the brush includes an electric motor which continuously rotates the brush head completely around, a full 360 degrees, again and again in the same continuous rotational direction, rather than cycling back and forth.

Brush Function of Depositing Shaving Cream onto the Face of a Man

A primary contemplated function of the present brush 100 is the application of shaving cream for men. A quantity of such shaving cream SC is placed in the chamber 20 and deposited onto facial skin by the rolling of the matter delivery balls 42. Then the bristles B rub the deposited shaving cream SC against user whiskers as the brush head oscillates at sonic frequency, thereby softening the whiskers and lubricating the skin so that they are easily removed by a razor without the need to apply significant force against the skin, providing a close shave without skin abrasions. As an alternative to sonic oscillation of the brush head 10, the brush head 10 is rotated relative to the skin for a short time in one rotational direction, such as one minute, and then for a short time in the directly opposing rotational direction, again such as for one minute. In either instance, the shaving cream filled brush 100 is an improvement over the shaving cream tray and hand moved brush used by prior generations of men.

Method of Depositing of Shaving Cream onto the Face of a Man

A method is provided of preparing the whiskers on the face of a man for shaving, including the steps of placing a quantity of shaving cream SC into a chamber 20 within a brush head 10 having bristles B, progressively releasing the shaving cream SC onto facial skin and whiskers while simultaneously moving the bristles B over the skin and whiskers, either with brush head 10 rotation reversal at what is referred to herein as sonic speed, thereby softening the whiskers and lubricating the skin.

Optional Pre-Measured Brush Head Refills and Optional Disposable Brush Head

The brush head 10 can be filled with pre-measured or pre-shaped pieces of lotion, cream or shaving cream, and water maybe added to liquify or semi-liquify and thereby become flowable material. Alternatively, the brush head 10 can be pre-filled with the flowable material and pre-sealed and inexpensively made to be disposable after the flowable material is depleted.

Third Preferred Embodiment

A retracting ball delivery apparatus 200 for flowable material M such as creams, lotion, medications and vitamins is further provided. The apparatus 200 includes a delivery retracting ball 210 and ball assembly 220 and a cartridge 250 containing flowable material and in fluid communication with the ball assembly 220 and ball 210. The ball assembly 220 preferably includes a ball assembly outer shell 322 having a distally located outer ball port 324 smaller in diameter than the ball 210 into which the ball 210 seats from inside the outer shell 322, and from outside an assembly inner shell 222 having an inner ball port 224. A ball spring 226 within the assembly inner shell 222 bears against and biasing the ball 210 to retractably and rotatably seat in the outer ball port 324, and a cartridge mount 230 to which an open end of a material cartridge 250 is sealingly and removably fitted. See FIGS. 16-19. Material M is delivered from the cartridge 250 to the retracting ball 210 through the ball assembly inner shell 222 and inner ball port 224, such that dragging the ball 210 over a target surface causes the ball 210 to rotate while retracting against the biasing of spring 226 so that material M deposited on the ball 210 within the assembly outer shell 322 rolls out between the ball 210 and outer ball port 324 rim as the ball 210 rotates against the target surface, carrying a uniform film or layer of material M and depositing it onto the target surface. The novel retractability of the biased ball 210, a key feature of the present invention, permits the material M to exit the assembly 220 on the ball 210 while the ball 210 is pressed against a target surface such as user skin, because the biased ball 210 bears against the rim of the ball outer port 324 and seals against release of material M when there is no force against the ball 210 from a target surface, so that material M is only dispensed when the ball 210 is in contact with a surface intended to receive the material M.

The assembly inner shell 222 includes an inner shell side wall 222*a* which preferably is cone or funnel shaped, having at its narrower distal end the inner ball port 224 and at its wider proximal end an assembly inner shell end wall 222*b* with a central assembly inner shell material receiving opening 222*c*. See FIG. 14. A tubular material passageway 228 preferably is attached to the assembly inner shell end wall 222*b* and protrudes distally from and encircles the material receiving opening 222*c*. The ball spring 226 preferably is a coil spring slidably fitted around the tubular material passageway 228, which acts as a spring retaining guide, so that the ball spring 226 is always compressed between the ball 210 and the assembly inner shell end wall 222*b*. The cartridge mount 230 preferably includes a tubular cartridge fitting 232 protruding proximally from the assembly inner shell end wall 222*b* and also encircles the material receiving opening 222*c*. A material cartridge 250 preferably is a hollow cylinder and the cartridge open end preferably is the at a cartridge 250 distal end, and this cartridge 250 distal end fits snugly and engagingly with friction into the tubular cartridge fitting 232 to place the cartridge 250 in fluid communication with the assembly inner shell 222 through the material receiving opening 222*c*. The cartridge open end preferably has a reduced diameter to define a cartridge neck 250*a* and a cartridge 250 shoulder at the cartridge 250 distal end.

The ball assembly inner shell 222 is releasably secured to a tubular apparatus housing 260, and the cartridge 250 extends from the assembly inner shell 222 inside the apparatus housing 260. It is preferred that the ball assembly includes assembly outer shell 322 of translucent plastic, again with an outer ball port 324 at the apparatus housing 260 distal end registering with and of at least the diameter of the ball port 224, and a tubular outer shell lip segment 244 protruding proximally beyond the ball assembly inner shell 222. The outer shell lip segment 244 preferably has internal threads IT which are sized to mesh with external threads ET on the apparatus housing 260 distal end so that the ball assembly inner shell 222 can be screwed onto and off of the apparatus housing 260 to provide access to change an empty material cartridge 250 and to perform any other desired maintenance. An apparatus cap 298 is preferably provided which fits snubly over the ball assembly 220 and engages the apparatus housing 260 outer surface with a friction grip.

The ball 210 preferably is formed of stainless steel. The apparatus housing 260 and assembly inner shell 222 preferably are formed of aluminum.

When the target surface is user skin, a preferred feature of apparatus 200 in addition to the retracting ball 210 is a ball charging circuit 270 delivering a small electric voltage and current to the ball 210 to stimulate the user skin during application of the material M. An electric power source 272 is connected to the cartridge 250 and to the conductive material M within the cartridge 250 through an apparatus circuit 270, so that the material M conducts and delivers electric voltage and current to the ball 210. A switch 274 preferably is included in the apparatus circuit 270 and preferably is mounted to the apparatus housing 260 to be operable from outside the housing 260, and controls the flow of electric current to the ball 210 weather to start or stop the current or simply to control its magnitude. The switch 274 preferably is a spring-loaded button which closes the circuit 270 to deliver current to the ball 210 only while depressed by a user finger. The power source 272 preferably is at least one battery such as conventional AAA batteries which are retained in a battery region 262 within the apparatus housing 260, and located either distally or proximally of the material cartridge 250. A removable battery access cap 264 preferably is provided at the apparatus housing 260 proximal end which can be unscrewed from the apparatus housing 260 to release spent batteries 272 and to permit insertion of new batteries 272 in their place. Within the battery access cap 264 is a battery spring 264*a* in the form of a distally protruding coil spring which bears against the proximal end of the nearest battery 272.

One version of apparatus 200 places the cartridge 250 between the batteries 272 and the assembly inner shell 222, so that the cartridge 250 is directly fitted to the assembly inner shell 222 as above described. The cartridge 250 is replaced by unscrewing the assembly outer shell lip segment 244 from the apparatus housing 260 and pulling the cartridge 250 free of the cartridge mount 230, and fitting an fresh, full cartridge 250 to the cartridge mount 230 as described.

Another version of apparatus 200 places the cartridge 250 at the proximal end of the apparatus housing 260, proximal of the batteries 272, so that the cartridge 250 is exposed and protruding from the apparatus housing 260. See FIG. 18. An advantage of this version is that the user can continually visually monitor the amount of material M remaining in a transparent cartridge 250, and replace the cartridge 250 when spent without having to open the apparatus housing 260. For this version, the apparatus housing 260 has an apparatus housing proximal end wall 266 with a material passing opening 266*a* similar to the material receiving opening 222*c* in the assembly inner shell end wall 222*b* and a tubular cartridge fitting 232 into which the cartridge 250 distal end snugly, engagingly sealingly and removably fits. A material delivery tube 268 preferably carries the material M from the cartridge 250 distally through the interior of the apparatus housing 260 and into the assembly inner shell 222.

A preferred additional feature of apparatus 200 is a vibrating element 280 contained within the apparatus housing 260 and connected to the apparatus circuit 270 for causing the ball 210 to vibrate or pulsate. Operation of the vibrating element 280 preferably is controlled by the same switch 274 controlling the delivery of electric current to the ball 210, although it is contemplated that vibrating element 280 operation may be controlled by a separate switch. The vibrating element 280 may be of any suitable design, and a preferred vibrating element 280 includes the electric motor 282 with a weight 284 eccentrically mounted to the motor drive shaft 286.

Figures 16, 17:
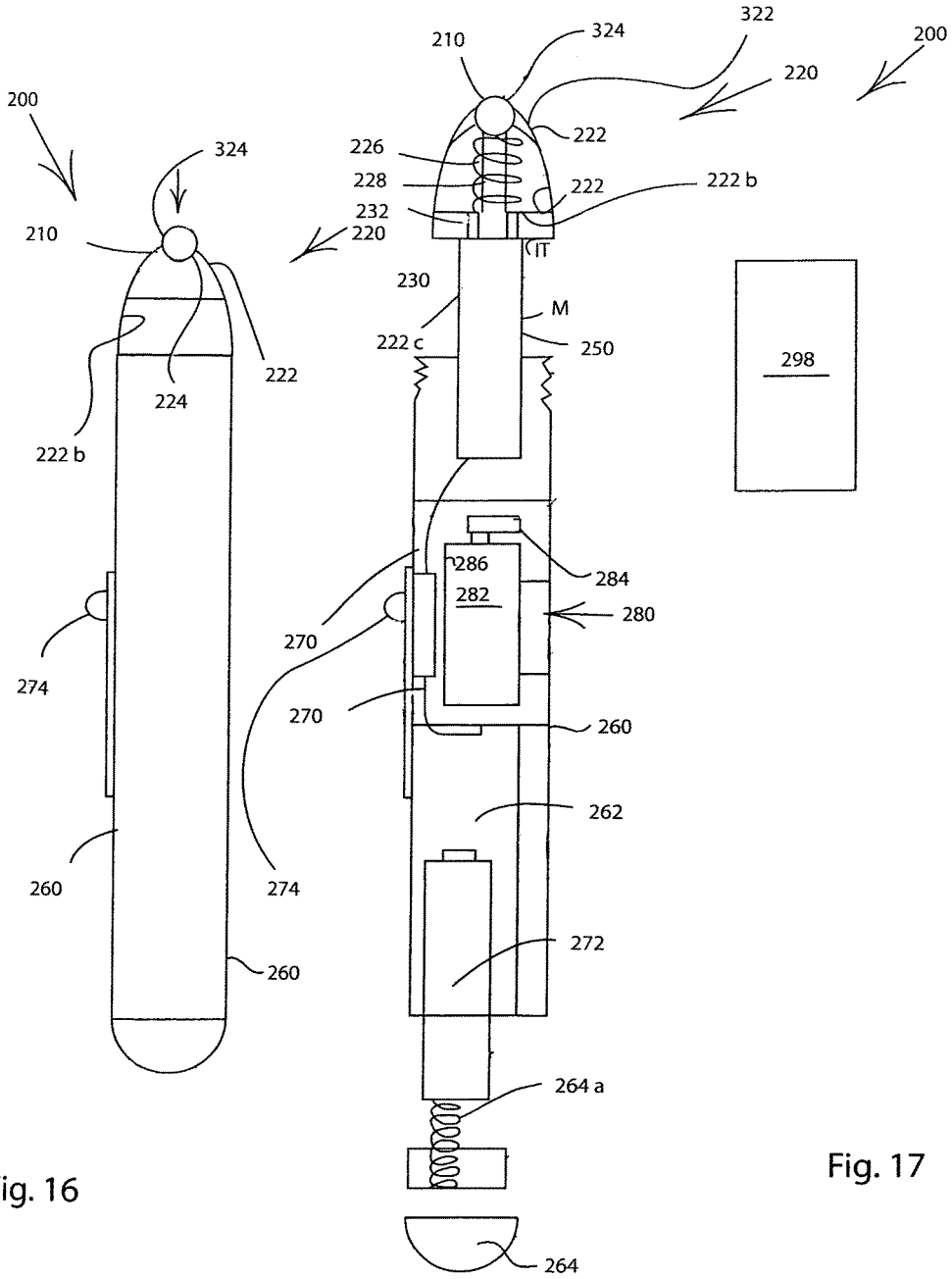
FIG. 16 is a side view of the retracting ball flowable material delivery apparatus.
FIG. 17 is an exploded, cross-sectional side view of the apparatus of FIG. 13.
Figure 18:
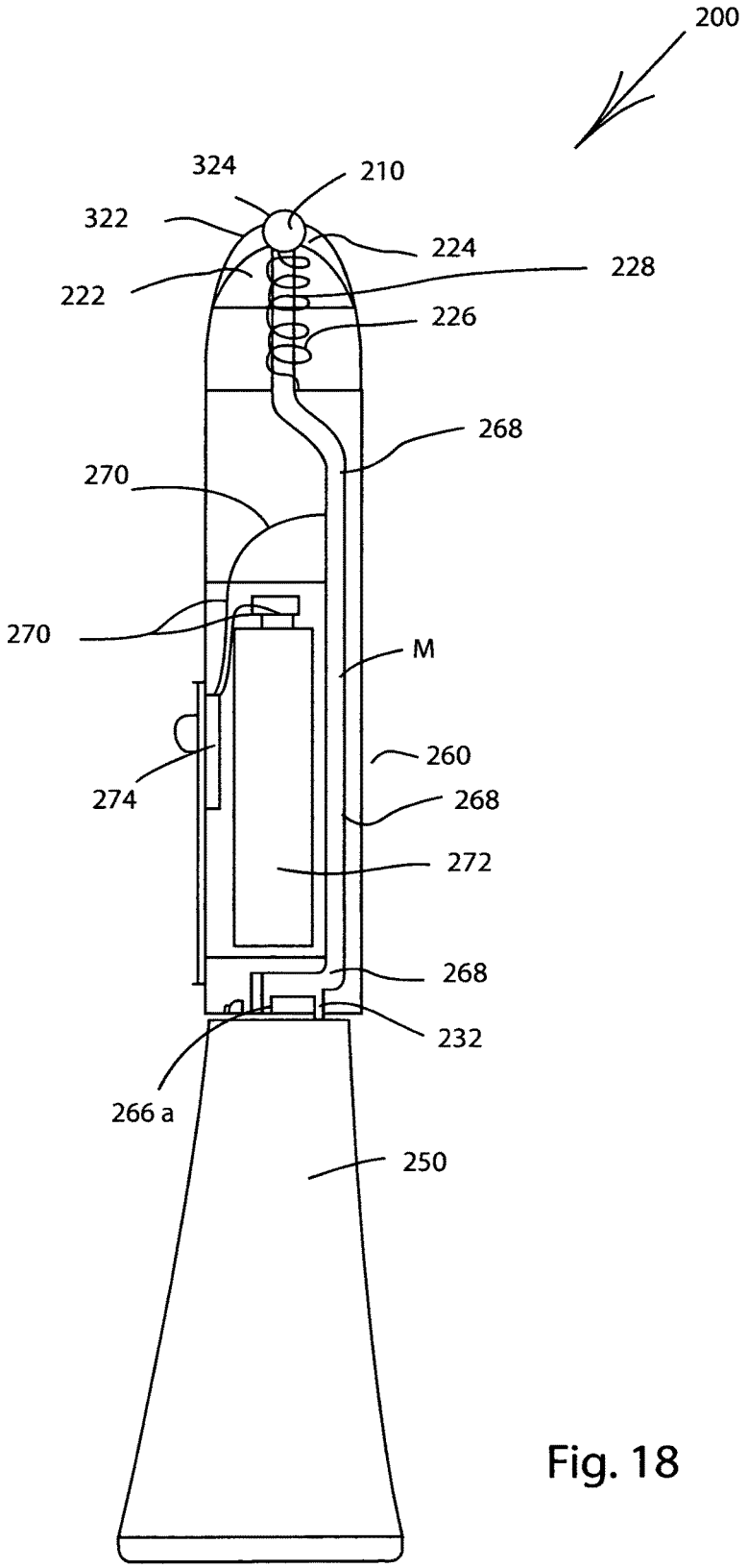
FIG. 18 is a side view of another version of the material delivery apparatus of FIGS. 16 and 17 in that the material cartridge is exposed and removably mounted to the apparatus proximal end.
Figure 19:
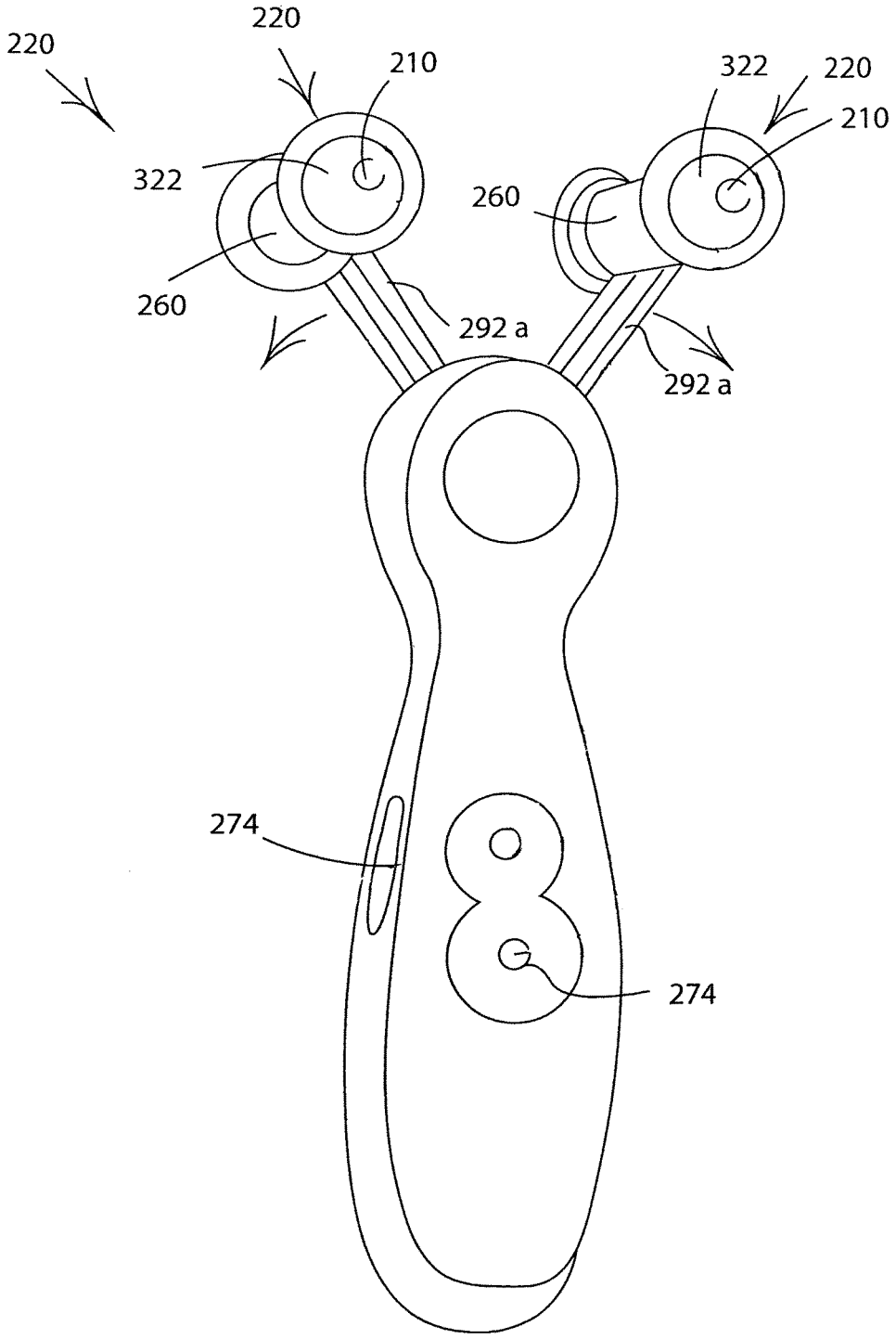
FIG. 19 is a perspective view of yet another version of the flowable material delivery apparatus of FIGS. 13-15 having and handle body with a retracting ball assembly incorporated into two independently pivotable application arms.
Figure 20:
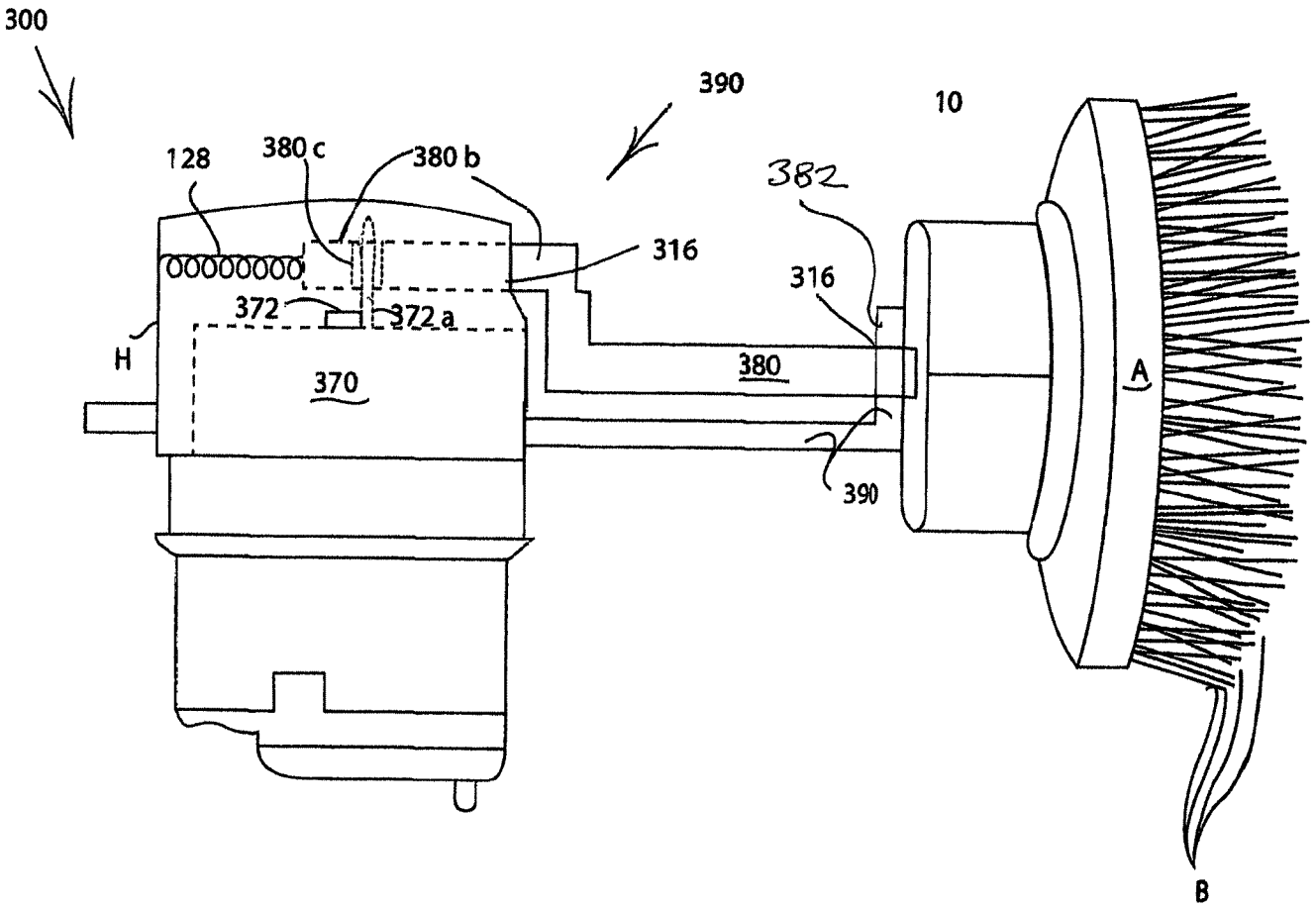
FIG. 20 is a side view of the fourth embodiment of the present invention which applies linear reciprocal motion to a brush head, with hidden portions of the reciprocating mechanism shown in broken lines.
Figure 21:
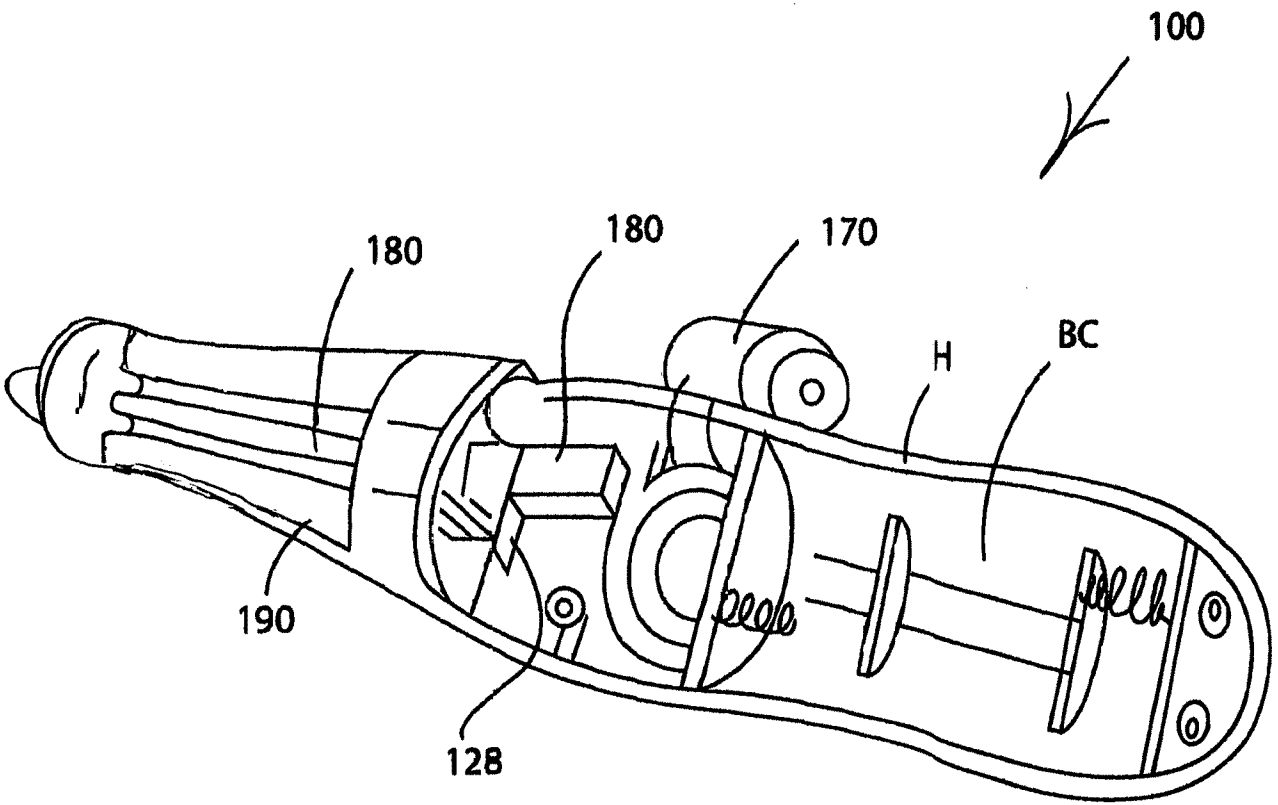
FIG. 21 is a side perspective view of a brush with the housing shown with a housing door open, having a reciprocating mechanism which reciprocates along the axis of the housing rather than at a right angle as in FIG. 13, to which a brush head can be attached, showing a housing side panel removed to reveal the drive motor, the return spring for mono-directional reciprocation, and the battery compartment for two AA or AAA batteries, with batteries removed.
Figure 22:
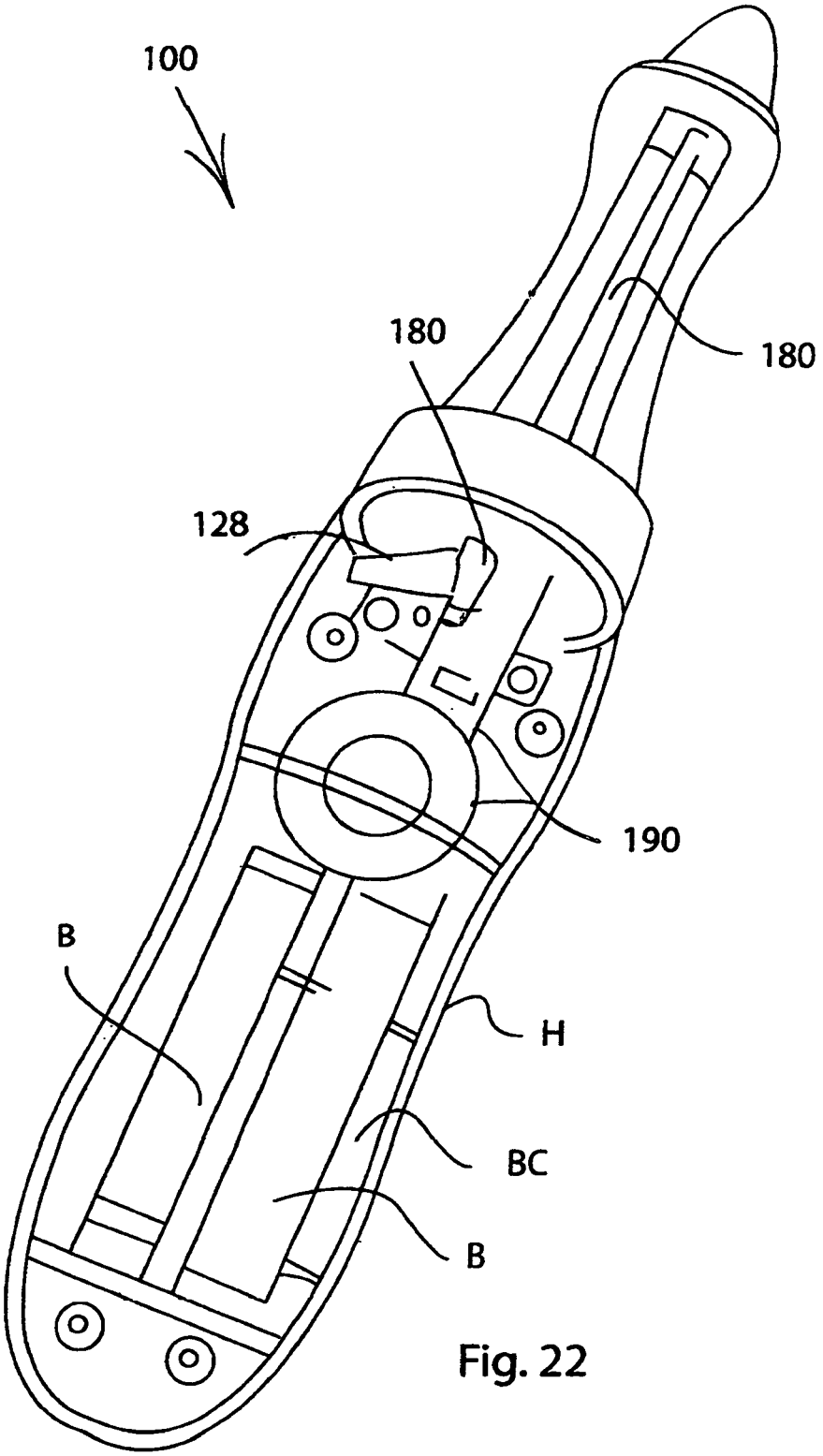
FIG. 22 is a top view of the brush of FIG. 21, with the housing once again shown open.
Figure 23:
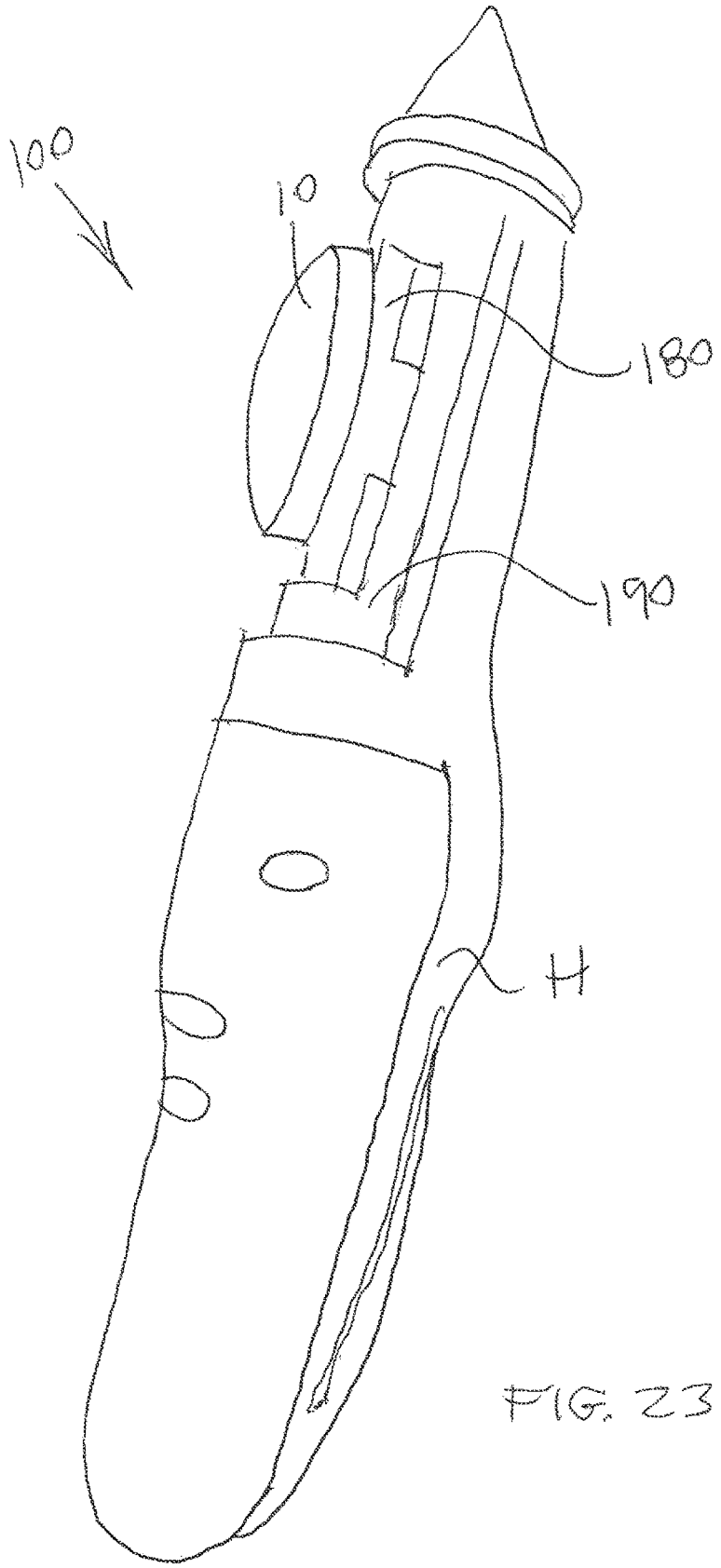
FIG. 23 is a side view of the brush of FIGS. 21 and 22, shown with the housing closed.
Figure 24:
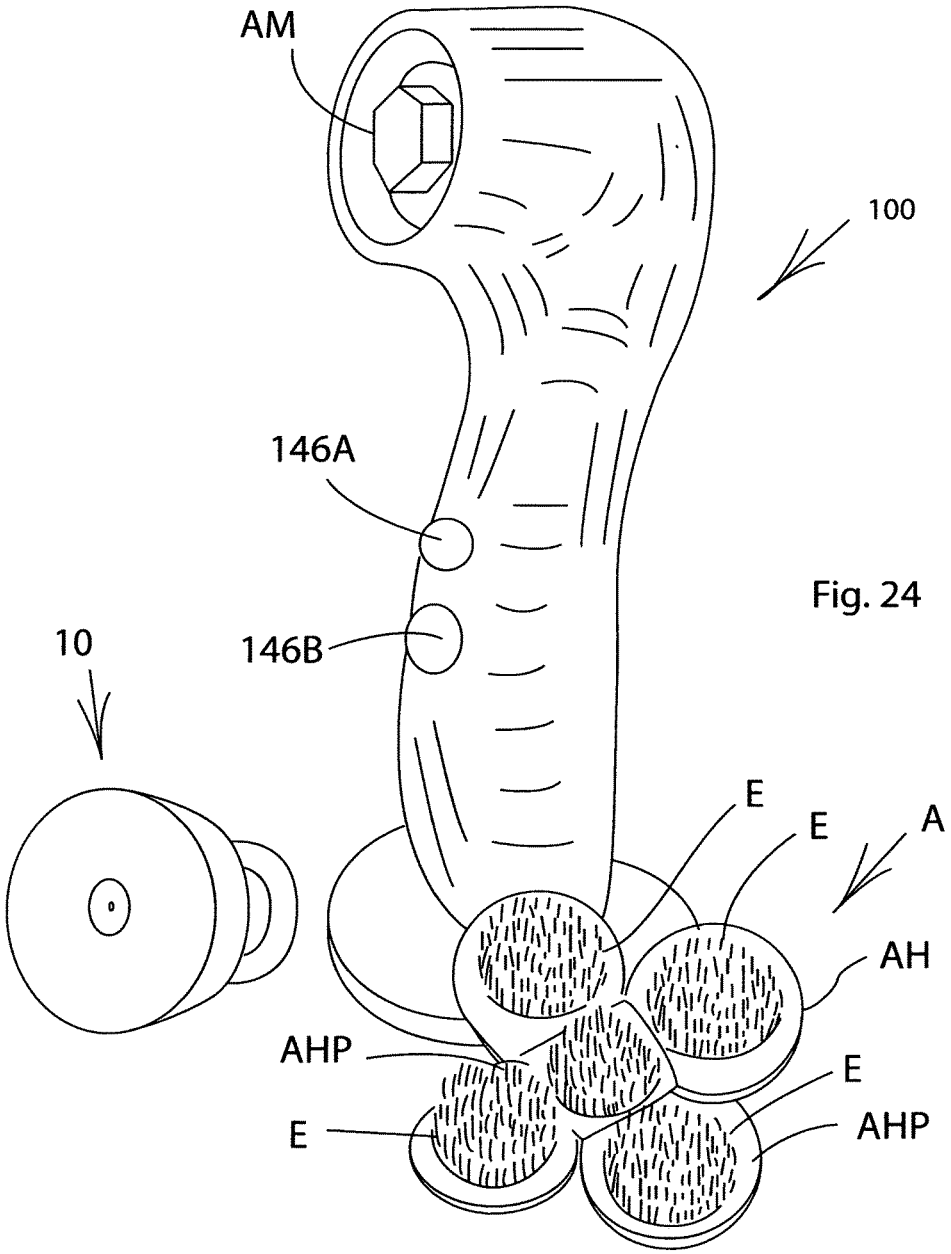
FIG. 24 is a front perspective view of the brush of FIG. 1 seated upright in a brush housing mount, with a rotating brush head which can be mounted to the brush attachment and an alternative multiple rotating brush head attachment containing planetary gears.
Figures 25, 26:
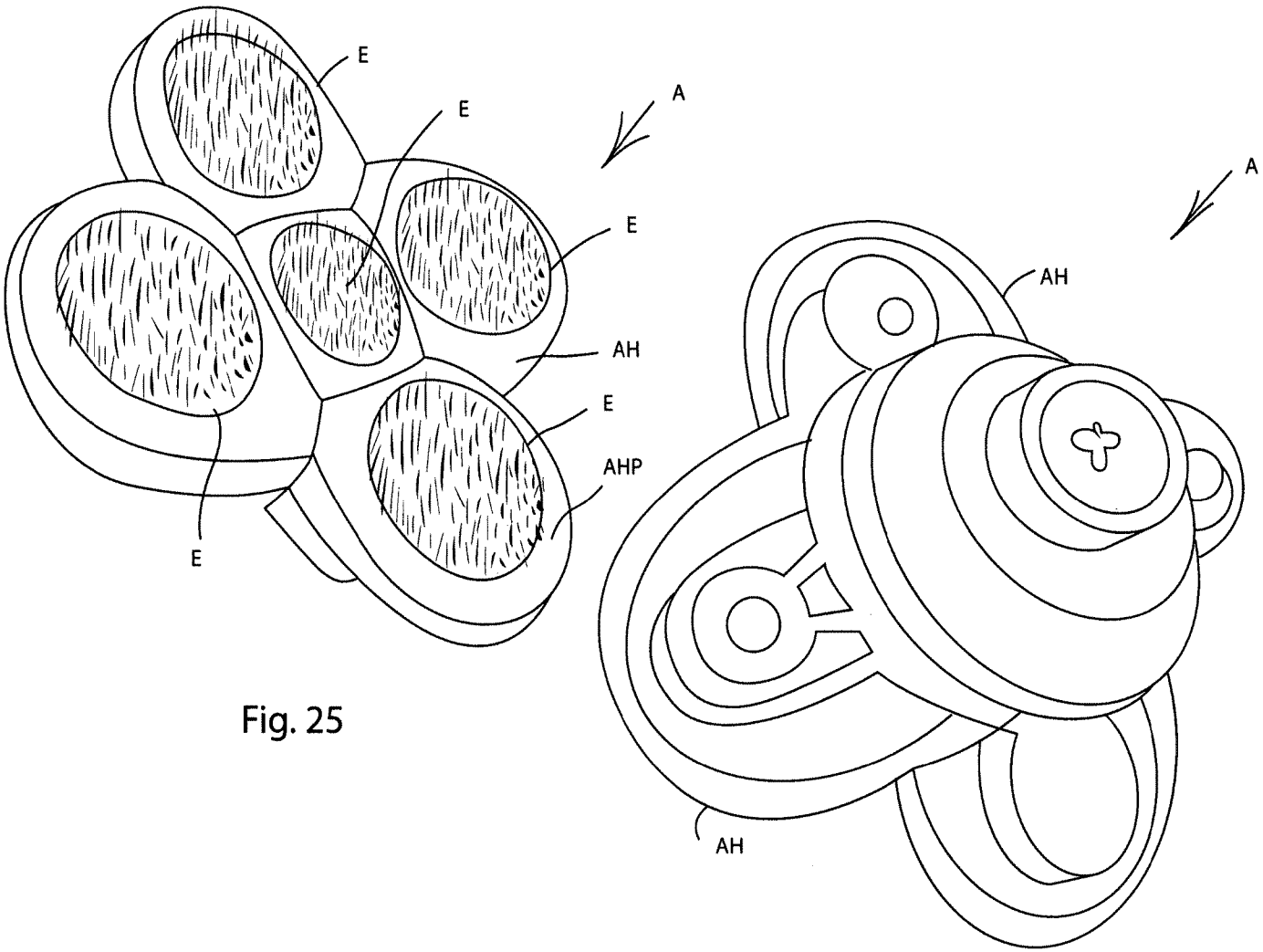
FIG. 25 is a front perspective view of the multiple brush head attachment of FIG. 22.
FIG. 26 is a rear perspective view of the attachment shown in FIG. 23.
Figure 27:
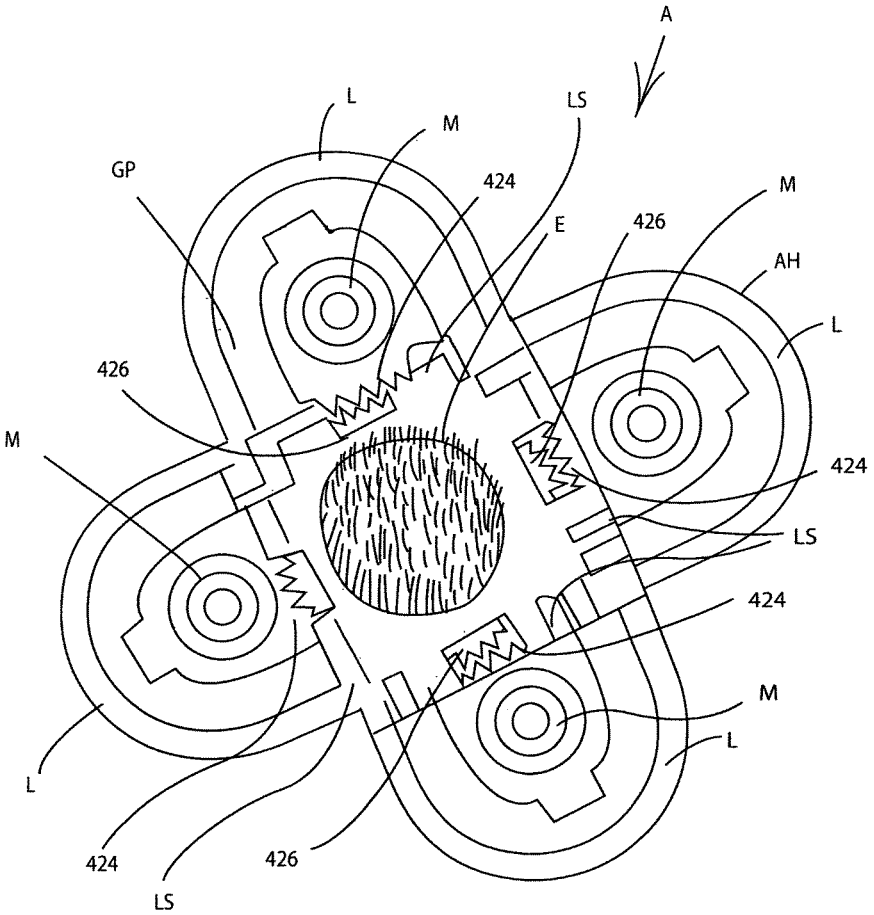
FIG. 27 is a front view of the multiple brush head attachment of FIG. 24 with the four outer brush heads removed from the attachment to reveal their brush head mounts, leaving only the center brush head mounted to the attachment.
Figure 28:
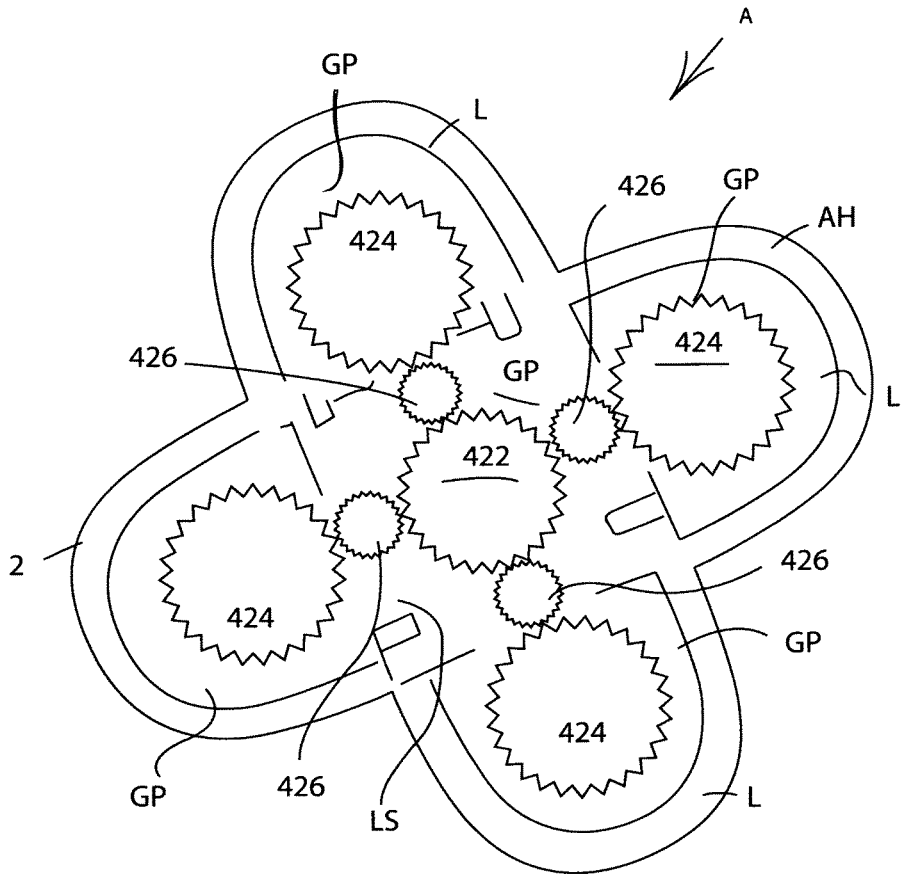
FIG. 28 is a view as in FIG. 26 with the forward wall of the attachment housing removed to reveal the planetary gears which drive and rotate the brush head mounts.
Figure 29:
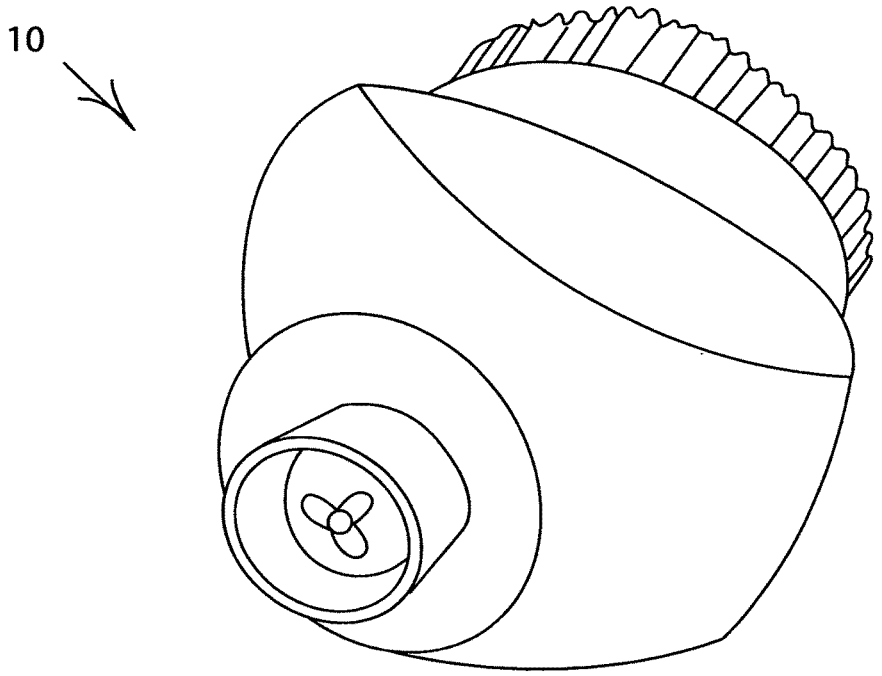
FIG. 29 is a rear perspective view of a brush head for mounting to the brush handle.
Figure 30:
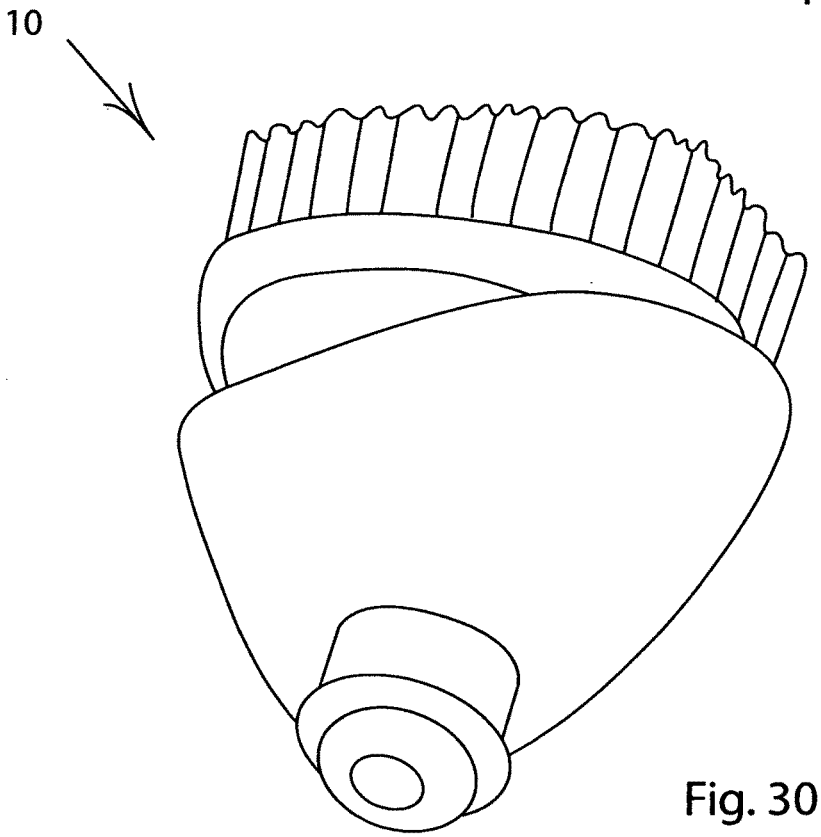
FIG. 30 is a side perspective view of the brush head of FIG. 26.
Figure 31:
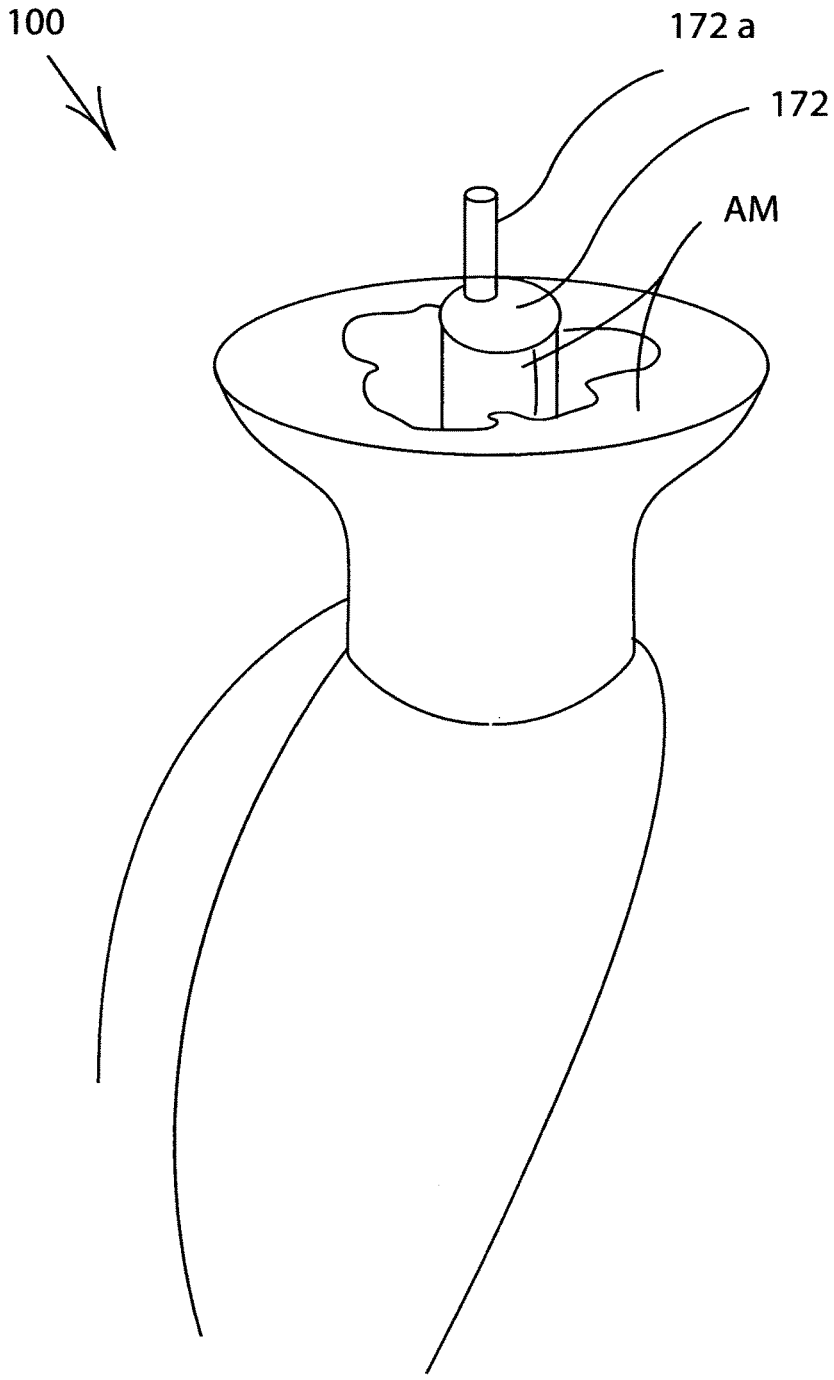
FIG. 31 is broken away side perspective view of the brush handle mount for securing an attachment, and of the motor drive shaft with its drive shaft eccentric portion.

The inventive retracting ball assembly 220 also is optionally affixed to or incorporated into devices of other configurations, such as that shown in FIG. 16. This version of the apparatus 200 includes two vibrating and independently pivoting arms 292 and a ball assembly 220 incorporated into each arm free end 292*a*. Electric current delivery switch 274 appears on the apparatus housing 260.

Fourth Preferred Embodiment

A fourth embodiment of the brush 300 is similar to the first embodiment except that the brush head 10 is oriented so that its bristles B protrude perpendicularly outwardly from the brush handle H and the brush head 10 is linearly reciprocated inwardly and outwardly relative to the brush handle H at what is termed sonic frequency. See FIG. 20. The fourth embodiment of brush 300 is intended primarily for applying flowable cosmetic material M such as make-up foundation in an even, uniform layer onto user skin.

The fourth embodiment once again includes a brush head moving mechanism in the form of a linear reciprocating mechanism 390 which reciprocates the brush head 10 a certain distance along its axis. The brush handle H is hollow and elongate and contains a brush head drive arm 380 and a drive shaft passing port 316 through which the drive arm 380 protrudes from inside the handle 314

Electric current is delivered from the power source such as a battery through a drive circuit which in turn delivers periodically reversing current to motor 370. The drive circuit preferably includes a power switch and a speed selection switch.

The linear reciprocating mechanism 390 for repetitively moving the brush head 10 at high frequency is provided which moves the brush head 10 in linear reciprocation rather than in rotational reciprocation. The motor 370 preferably is designed to rotate at 100 to 400 revolutions per minute is provided, and a lateral portion of the free end of the motor drive shaft 372 is cut away so that the remaining eccentric drive shaft portion 372*a* rotates off-center. See FIG. 13. A drive end 380*b* of a brush drive arm 380 has a guide arm recess 380*c* which closely fits over the eccentric drive shaft portion 372 passes slidably through a guide slot 378 in the guide arm drive shaft portion 372*a* and protrudes laterally of the drive shaft 372, and a brush head 10 is affixed perpendicularly to the brush guide arm 380, preferably the brush guide arm opposing end 380*a* opposite the guide arm drive end 380*b*. The guide arm 380 is reciprocally mounted to an elongate guide member 394 having a guide member flange fixed to and relative to the remainder of the brush 300, and a flexible guide arm retaining link 382 preferably, As a result of this construction, connection of the motor 370 to an electric power source 360 through completion of the brush circuit causes the motor drive shaft 372 to rotate, and the eccentric drive shaft portion 372*a* to rotate off-center, imparting a reciprocal longitudinal motion to the brush drive arm 380, moving the brush head 10 and reciprocally in a cycle and at a speed matching the speed of rotation of the motor drive shaft 372. This fast movement is considered another version of what is termed in this application a sonic or ultrasonic action.

Attachments with Self-Contained Rotary Motion Multiplication Transmission and with Conversion Mechanism for Converting Rotational Motion to Reciprocating Motion A handle base 100 preferably is provided which generates only rotational motion at its attachment mount AM. See FIG. 24. A first general type of attachment A such as a brush head 10 requires only rotational motion, and this structure simply removably connects to the attachment mount AM and rotate with the mount AM. See FIG. 24.

A second general type of attachment A is provided which has multiple rotational elements E which must each rotate independently of the other such elements E and relative to the attachment housing AH. This preferably is achieved with a planetary gear assembly 420 within the attachment housing AH, and while the attachment housing AH remains stationary relative to the handle base 100, the rotating attachment mount AM rotates the sun gear 422 which independently rotates the planet gears 424, preferably through intermediary gears 426, and thus rotates the rotation elements E that are drivably connected to respective planet gears 424. The rotation elements E, such as brush heads 10, preferably are mounted on brush head mounts M fixedly connected to planet gears 424 to rotate together with respective planet gears 424. See FIGS. 24-30. For example, mounts M optionally are affixed to planet gear axles to which the planet gears 424 are fixedly mounted to be constrained to rotate together with the planet gears 424. The planet gear axles extend through respective ports in a planar outer housing portion AHP of the attachment A so that the brush head mounts M are on the outside of the attachment housing AH. The sun gear 422 is located at a middle platform region and sun gear 422 and the planet gears 424 are mounted on pivotable, outwardly protruding platform leaf portions L. A brush head mount M preferably is fixedly connected to the sun gear 422 as well. The leaf portions L pivot rearwardly against biasing of a leaf spring LS so that the gear platform GP as a whole can from moment to moment follow and conform to the shape of the user body surface. The elements E preferably are brush heads with bristles B.

A third general type of attachment A is provided which must move with reciprocation, either linear or rotational, preferably at sonic reciprocating speeds of, for example, 500 or 1000 cycles per minute. See FIG. 30. This type of attachment A has an attachment housing AH which contains a rotation to reciprocation transmission mechanism 192. The brush head 10 moving mechanism 110 includes an electric motor 170 with a motor drive shaft 172. As in the handle base 100 described for an above-described embodiment, and the attachment reciprocation transmission mechanism 194 includes a jog structure 196 secured to the motor drive shaft

172 free end having a convertor drive disk 172*b* and an off center drive shaft eccentric portion 172*a* protruding outwardly from the drive disk 172*b* parallel but laterally spaced from the motor drive shaft rotational axis L. A reciprocating guide arm 170 is further included and has a laterally oriented slot 180*c* which transmits only the longitudinally reciprocating portion of the drive shaft eccentric portion 172*a* rotational movement to the attachment mount AM, thereby transforming rotation motion into linear reciprocating motion. The drive circuit 146 preferably includes a power switch 146A which activates and deactivates the motor 170 and a speed selection switch 146B. The motor 170 preferably is operated at either of two discrete speeds selected by the user by operating a speed selection switch, one speed preferably causing sonic reciprocation of the rotating elements E of 500 cycles per minute, and the other at 1000 cycles per minute.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A brush, comprising:

a brush head with outwardly protruding bristles for applying cosmetics material to the skin of a person;

a brush head moving mechanism which is a linear reciprocating mechanism for repetitively moving said brush head in linear reciprocation, comprising:

a drive motor having a motor drive shaft with a drive shaft free end and an eccentric drive shaft portion which rotates with said drive shaft off-center;

a brush drive member having a drive member recess which fits closely over and around said eccentric drive shaft portion and protrudes laterally with respect to said drive shaft, said brush head being affixed to said brush drive member, said brush drive member being reciprocally mounted to a guide member fixed to the remainder of said brush, such that said drive motor drives said brush drive member cyclically from a first end of a range of motion to a second end of the range of motion;

a return spring mounted in biasing relation to said brush drive member and having sufficient resilient force to cause said brush drive member and brush head to return to the first end of the range of motion when said motor is disconnected from an electric power source;

such that the brush head always stops at and subsequently starts from the first end of the range of motion;

and a brush circuit for electrically connecting said motor to an electric power source;

such that connection of said motor to said electric power source through completion of said brush circuit causes said motor drive shaft to rotate, and said eccentric drive shaft portion to rotate off-center, imparting a reciprocal motion to said brush drive member, moving said brush head reciprocally linearly at a cyclical speed matching the rotational speed of said motor drive shaft.

2. The brush of claim 1, wherein said motor is designed to rotate at 100-400 revolutions per minute.

3. A brush, comprising:

a brush head with outwardly protruding bristles for applying cosmetics material to the skin of a person;

a brush head moving mechanism which is a reciprocating mechanism for repetitively moving said brush head in reciprocation, comprising:

a drive motor having a motor drive shaft with having a drive shaft free end and a cam structure connected to said drive shaft free end driven by said drive shaft;

a brush drive member mounted in driving relation to said cam structure, said brush head being affixed to said brush drive member, said brush head drive member being reciprocally mounted to a guide member fixed to the remainder of said brush, such that said drive motor drives said brush drive member cyclically from a first end of a range of motion to a second end of the range of motion;

a return spring mounted in biasing relation to said brush drive member and having sufficient resilient force to cause said brush drive member and brush head to return to the first end of the range of motion when said motor is disconnected from an said electric power source;

such that the brush head always stops at and subsequently starts from the first end of the range of motion;

and a brush circuit for electrically connecting said motor to an electric power source;

such that connection of said motor to said an electric power source through completion of said brush circuit causes said motor drive shaft to rotate, and said cam structure to rotate, imparting a reciprocal motion to said brush drive member, moving said brush head reciprocally at a cyclical speed matching the rotational speed of said motor drive shaft.

4. The brush of claim 3, wherein said motor is designed to rotate at 100-400 revolutions per minute.

* * * * *